US009290947B2

(12) United States Patent
Meier

(10) Patent No.: US 9,290,947 B2
(45) Date of Patent: Mar. 22, 2016

(54) STAIR SYSTEMS AND WALL ASSEMBLIES COMPRISING SAME

(75) Inventor: Daniel Colin Meier, Vancouver (CA)

(73) Assignee: Diamond Stairs Inc., Calgary (CA)

( * ) Notice: Subject to any disclaimer, the term of this patent is extended or adjusted under 35 U.S.C. 154(b) by 0 days.

(21) Appl. No.: 14/418,896

(22) PCT Filed: Jul. 31, 2012

(86) PCT No.: PCT/CA2012/000737

§ 371 (c)(1),
(2), (4) Date: Jan. 30, 2015

(87) PCT Pub. No.: WO2014/019054

PCT Pub. Date: Feb. 6, 2014

(65) Prior Publication Data

US 2015/0284962 A1 Oct. 8, 2015

(51) Int. Cl.

| | |
|---|---|
| ***E04F 11/00*** | (2006.01) |
| ***E04F 19/10*** | (2006.01) |
| ***E04F 11/022*** | (2006.01) |
| ***E04B 1/41*** | (2006.01) |

(Continued)

(52) U.S. Cl.

CPC ..... *E04F 11/022* (2013.01); *E04B 1/40* (2013.01); *E04F 11/0223* (2013.01); *E04F 11/112* (2013.01); *E04F 2011/0209* (2013.01)

(58) Field of Classification Search

CPC ..... E04F 11/022; E04F 11/0223; E04F 11/02; E04F 11/0201; E04F 11/032; E04B 1/40

USPC ..... 52/182, 183, 184, 185, 186, 188

See application file for complete search history.

(56) References Cited

U.S. PATENT DOCUMENTS

| | | | | |
|---|---|---|---|---|
| 1,951,895 | A | 3/1934 | Bauer | |
| 2,105,565 | A | 1/1939 | von Schantz | |
| 2,724,466 | A * | 11/1955 | Phillips | 52/191 |

(Continued)

FOREIGN PATENT DOCUMENTS

| | | |
|---|---|---|
| CA | 2 507 015 A1 | 7/2004 |
| DE | 1 965 697 A1 | 7/1971 |

(Continued)

OTHER PUBLICATIONS

International Search Report of the International Searching Authority completed Feb. 20, 2013 in PCT/CA2012/000737, filed Jul. 31, 2012, 3 pages.

(Continued)

*Primary Examiner* — Mark Wendell
*Assistant Examiner* — Keith Minter
(74) *Attorney, Agent, or Firm* — Lewis Roca Rothgerber Christie LLP

(57) ABSTRACT

A stair system according to one illustrative embodiment comprises: a support body mountable in a wall and comprising a connecting region; a stair body; and a mounting apparatus. The mounting apparatus comprises: a connector connectable to the connecting region of the support body in any one of a plurality of different positions in the connecting region of the support body; and a holder configured to hold the stair body such that when the connector is connected to the connecting region of the support body, the stair body is spaced apart from the support body to permit a wall panel between the stair body and the support body. Wall assemblies comprising such stair systems are also disclosed.

28 Claims, 25 Drawing Sheets

(51) Int. Cl.
*E04F 11/112* (2006.01)
*E04F 11/02* (2006.01)

(56) References Cited

U.S. PATENT DOCUMENTS

| | | | | | |
|---|---|---|---|---|---|
| 2,888,182 | A * | 5/1959 | Nixon | 182/1 |
| 3,492,766 | A | 2/1970 | Andrews | |
| 4,285,178 | A | 8/1981 | Holzkämpfer et al. | |
| 4,397,127 | A | 8/1983 | Mieyal | |
| 4,586,585 | A | 5/1986 | Zaner | |
| 4,930,277 | A | 6/1990 | Krumholz et al. | |
| 4,936,067 | A | 6/1990 | Menchetti | |
| 5,086,595 | A * | 2/1992 | Maiuccoro et al. | 52/183 |
| 5,459,964 | A | 10/1995 | Doublet | |
| 5,551,194 | A * | 9/1996 | Toomey | 52/184 |
| 5,660,009 | A | 8/1997 | Cousin | |
| 5,802,773 | A | 9/1998 | Pingel | |
| 6,516,574 | B1 * | 2/2003 | Couture | 52/182 |
| 6,938,387 | B2 | 9/2005 | Belanger | |
| 2003/0093959 | A1 * | 5/2003 | Couture | 52/182 |
| 2008/0040991 | A1 * | 2/2008 | Gianelo | 52/182 |
| 2008/0196330 | A1 * | 8/2008 | Frank et al. | 52/182 |
| 2009/0205267 | A1 * | 8/2009 | Prins | 52/105 |
| 2011/0146169 | A1 * | 6/2011 | Ronsheim | 52/188 |

FOREIGN PATENT DOCUMENTS

| | | | |
|---|---|---|---|
| DE | 1965697 | | 7/1971 |
| DE | 26 15 049 | A1 | 10/1977 |
| DE | 2615049 | | 10/1977 |
| EP | 2 172 601 | A2 | 4/2010 |
| FR | 2 651 822 | A1 | 3/1991 |
| JP | 2006-132240 | A | 5/2006 |
| JP | 2009-144437 | A | 7/2009 |
| JP | 2009-275404 | A | 11/2009 |

OTHER PUBLICATIONS

Written Opinion of the International Searching Authority mailed Mar. 19, 2013 in PCT/CA2012/000737 filed Jul. 3, 2012, 5 pages.
Diamond Stairs, Diamond Stairs, Website printout, retrieved from www.diamondstairs.com/system.html on Feb. 2, 2012, 2 pages.
Diamond Stairs, DWGS001-006, Copyrighted 2011, 6 pages.
Diamond Stairs, Install Guide with Labels and Instructions, Copyrighted 2011, 7 pages.
Diamond Stairs, Install Guide, Copyrighted 2011, 7 pages.
International Search Report mailed Mar. 19, 2013, issued in PCT/CA2012/000737, 3 pages.
Written Opinion of the International Searching Authority mailed Mar. 19, 2013, issued in PCT/CA2012/000737, 5 pages.

* cited by examiner

STAIR SYSTEMS AND WALL ASSEMBLIES COMPRISING SAME

CROSS-REFERENCE TO RELATED APPLICATION

This application is a national stage of International Application No. PCT/CA2012/000737 filed Jul. 31, 2012, the entire content of which is incorporated herein.

BACKGROUND

1. Field

The invention relates generally to stair systems and to wall assemblies comprising such stair systems.

2. Related Art

A stair must bear significant loads, for example as individuals step on the stair and transfer significant weight, sometimes suddenly, to the stair. Many stairs are supported on undersides of the stairs by stair stringers having sufficient strength to bear such loads. However, such stair stringers are often either concealed by some cover or covers, or exposed to view. The cover or covers, or the stair stringers themselves if exposed to view, may impart an undesirably functional appearance to the stairs. Further, such stair stringers and covers may undesirably occupy space surrounding the stairs.

Alternatively, some stairs are supported by structures other than stair stringers, but in order to withstand the significant loads that stairs may transfer to such structures, such structures are often large or complex, and thus may also impart an undesirably functional appearance to the stairs or may undesirably require costly components and time-consuming installation that may be intrusive to construction or to renovation. Further, where such structures cantilever a stair body to a wall, such a cantilever structure can damage the wall as loads from the stair are applied to the wall.

SUMMARY

According to one illustrative embodiment, there is provided a stair system comprising: a support body mountable in a wall and comprising a connecting region; a stair body; and a mounting apparatus. The mounting apparatus comprises: a connector connectable to the connecting region of the support body in any one of a plurality of different positions in the connecting region of the support body; and a holder configured to hold the stair body such that when the connector is connected to the connecting region of the support body, the stair body is spaced apart from the support body to permit a wall panel between the stair body and the support body.

According to another illustrative embodiment, there is provided a wall assembly comprising: a wall comprising a plurality of wall studs and a wall panel mounted on front surfaces of the wall studs; and a first stair system. The support body of the first stair system is mounted in the wall. The connector of the mounting apparatus of the first stair system is connected to the connecting region of the support body of the first stair system in one of the plurality of different positions in the connecting region of the support body of the first stair system. The holder of the mounting apparatus of the first stair system holds the stair body of the first stair system such that the stair body of the first stair system is spaced apart from the support body of the first stair system with the wall panel between the stair body of the first stair system and the support body of the first stair system.

Other aspects and features of the present invention will become apparent to those ordinarily skilled in the art upon review of the following description of specific illustrative embodiments in conjunction with the accompanying figures.

DETAILED DESCRIPTION

Figure 1:
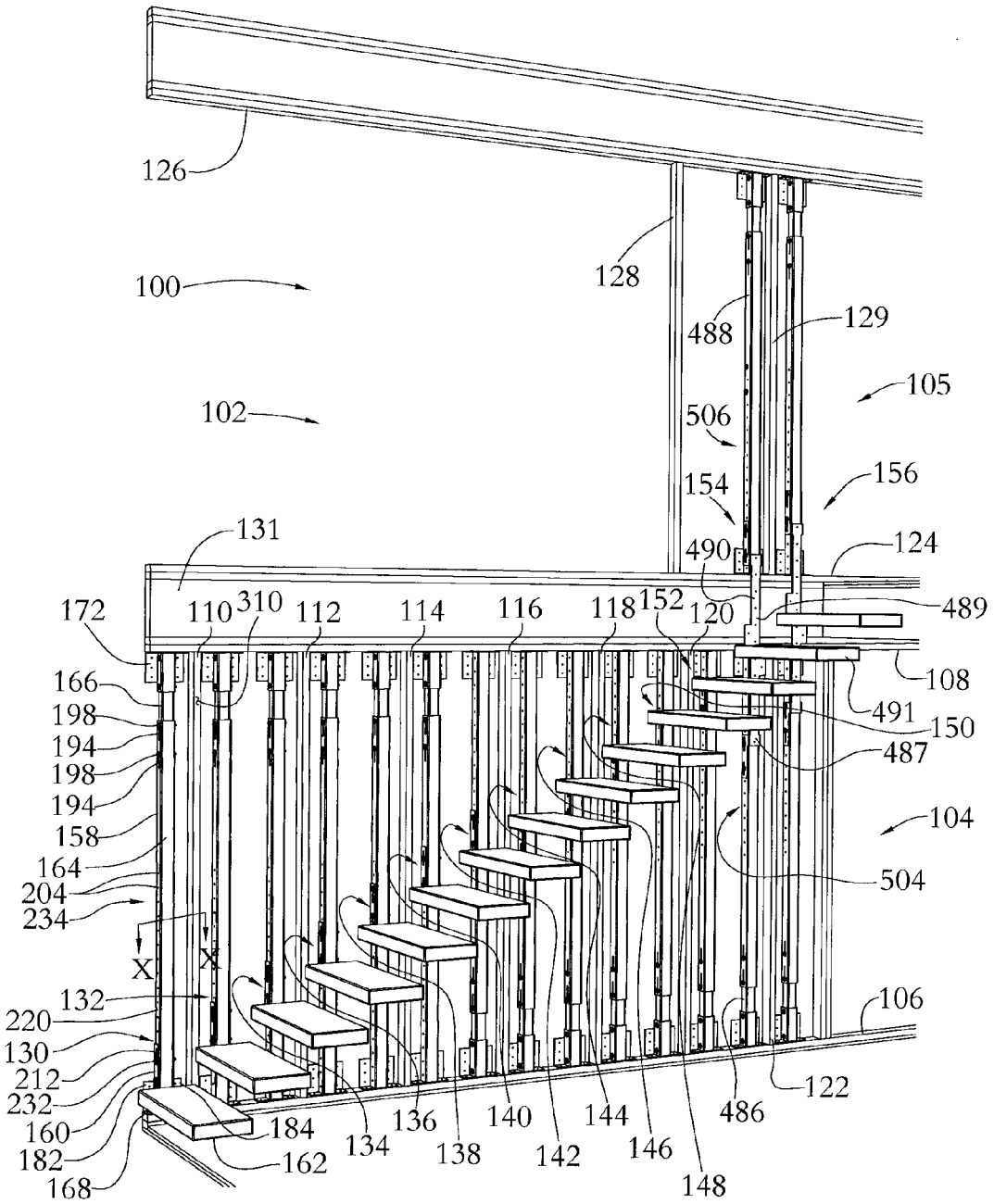
FIG. 1 is a perspective view of a wall assembly according to one illustrative embodiment.

Referring to FIG. 1, a wall assembly according to one illustrative embodiment is shown generally at 100. The wall assembly 100 includes a wall shown generally at 102, which includes a lower wall shown generally at 104 and an upper wall shown generally at 105. The lower wall 104 includes bottom plates 106, top plates 108, and wall studs 110, 112, 114, 116, 118, 120, and 122 extending generally vertically between the bottom plates 106 and the top plates 108. In this context, "generally vertically" means either exactly vertically or sufficiently vertically to function as wall studs in the embodiment shown. More generally, "generally" herein refers to either exactly or sufficiently close to function as described herein. In the embodiment shown, generally vertical center lines of the wall studs 110, 112, 114, 116, 118, 120, and 122 are spaced apart from each other by a spacing distance of about 24 inches (or about 61 centimeters). The upper wall 105 includes bottom plates 124, top plates 126, and wall studs 128 and 129 extending generally vertically between the bottom plates 124 and the top plates 126. Further, the wall 102 also includes a floor joist 131 between the top plates 108 of the lower wall 104 and the bottom plates 124 of the upper wall 105. In alternative embodiments, the floor joist 131 may include or be replaced with a beam, Rim Board™, laminated veneer lumber ("LVL"), or other structural elements of a wall of a building, for example.

In the embodiment shown, the wall studs 110, 112, 114, 116, 118, 120, 122, 128, and 129, the bottom plates 106 and 124, the top plates 108 and 126, and the floor joist 131 include various dimensional lumber products in a building frame. More particularly, each of the wall studs 110, 112, 114, 116, 118, 120, 122, 128, and 129 in the embodiment shown is a dimensional lumber timber product known as a "2×4" and having a width of about 3.5 inches (or about 8.9 centimeters), a depth of about 1.5 inches (or about 3.8 centimeters), and a height of about 8 feet (or about 244 centimeters).

The wall assembly 100 also includes a plurality of stair systems, which are shown in FIG. 1 generally at 130, 132, 134, 136, 138, 140, 142, 144, 146, 148, 150, 152, 154, and 156. In general, in the embodiment shown, each of the stair systems 130, 132, 134, 136, 138, 140, 142, 144, 146, 148, 150, 152, 154, and 156 includes a stair having a horizontal tread depth of about 12 inches (or about 30.5 centimeters), and horizontal longitudinal centers of such stairs are spaced about 12 inches (or about 30.5 centimeters) horizontally apart from each other. Therefore, in the embodiment shown, respective facing vertical edges of adjacent stairs are generally in a common vertical plane, and two stair systems may be supported between adjacent wall studs, such as the stair systems 132 and 134 between the wall studs 110 and 112 for example.

In an alternative embodiment (not shown), generally vertical center lines of the wall studs 110, 112, 114, 116, 118, 120, and 122 may be spaced apart from each other by a spacing distance of about 22 inches (or about 55.9 centimeters), and in such embodiments where each of the stairs has a horizontal tread depth of about 12 inches (or about 30.5 centimeters) and where two stair systems are supported between adjacent wall studs, horizontal longitudinal centers of such stairs may be spaced about 11 inches (or about 28 centimeters) horizontally from each other, and each such stair may vertically overlap an adjacent stair over a horizontal overlap depth of about 1 inch (or about 2.5 centimeters).

Figure 2:
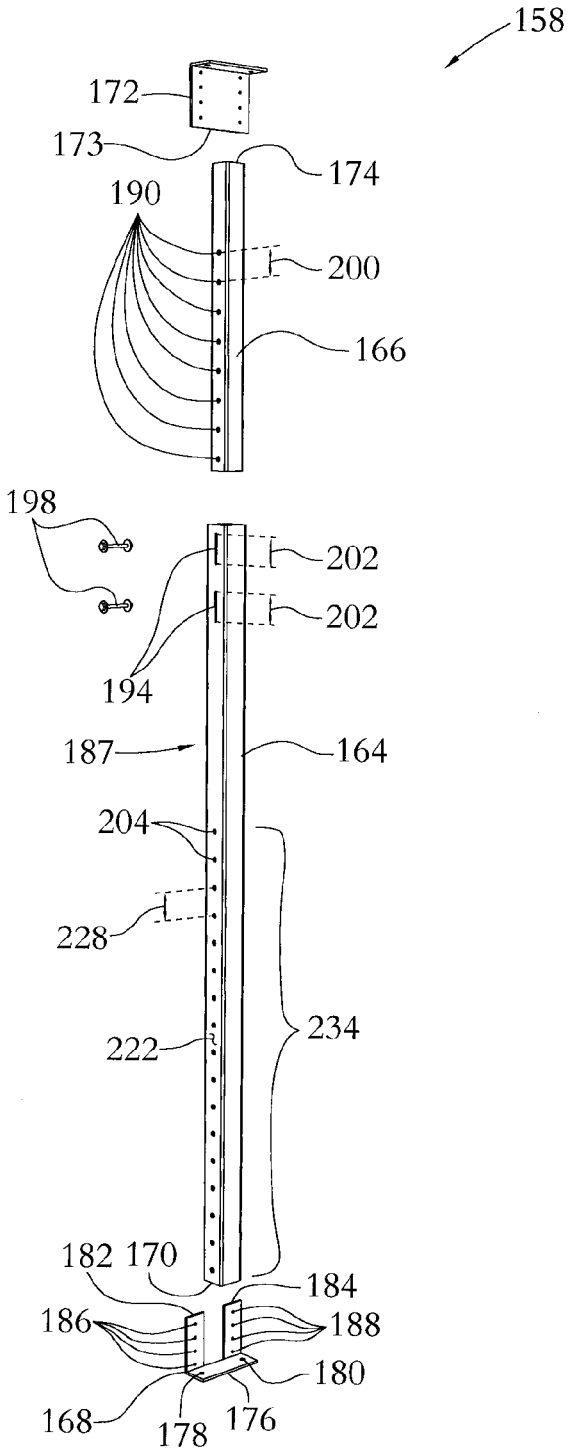
FIG. 2 is a left-side exploded perspective view of a support body of the wall assembly of FIG. 1.
Figure 3:
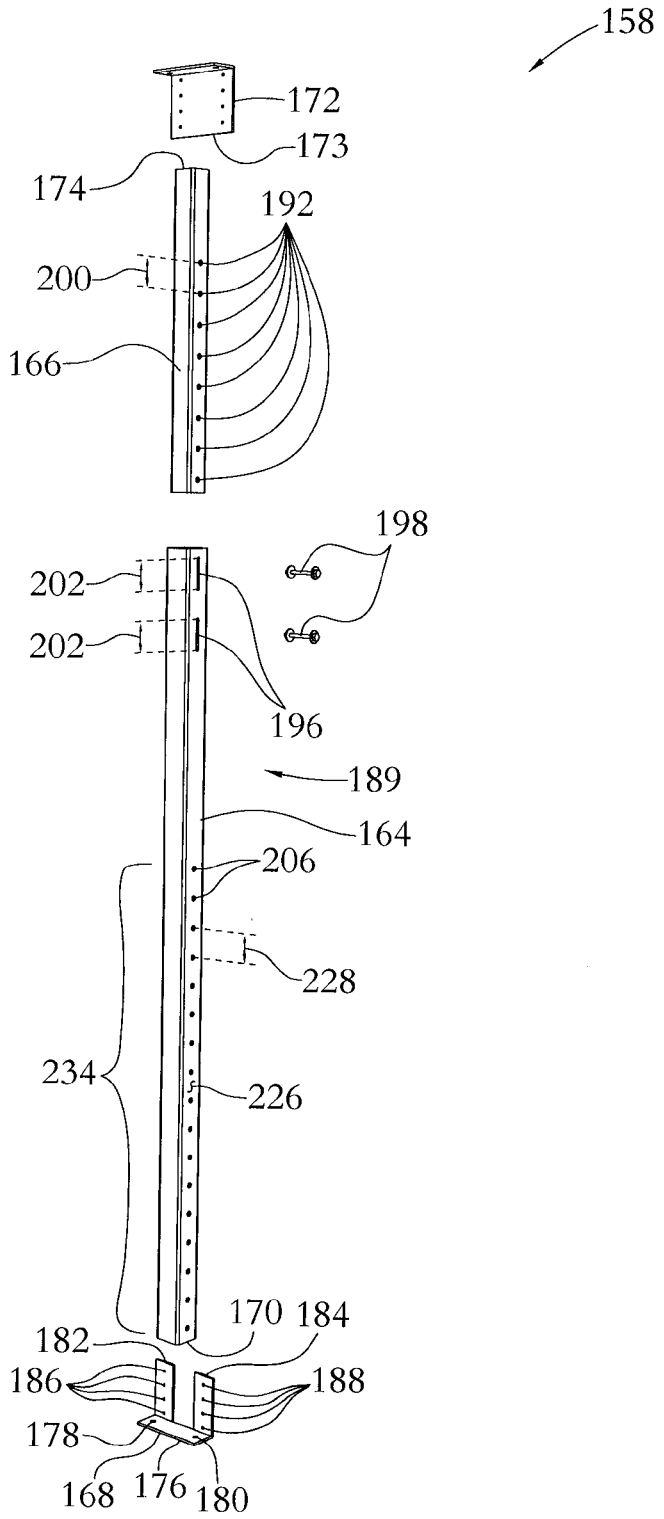
FIG. 3 is a right-side exploded perspective view of the support body of FIG. 2.

The stair system 130 includes a support body 158, a mounting apparatus 160, and a stair body 162. Referring to FIGS. 2 and 3, the support body 158 includes a first portion 164, which in the embodiment shown is an elongate square steel tube having a length of about 101 inches (or about 256.5 centimeters). The support body 158 also includes a second portion 166, which in the embodiment shown is an elongate square steel tube having a length of about 51.5 inches (or about 130.8 centimeters).

The support body 158 also includes a first fastening body 168, which in the embodiment shown is formed from a ¼" formed steel plate, and which may be coupled (by welding, for example) to the first portion 164 proximate an end 170 of the first portion 164. The support body 158 also includes a second fastening body 172, which in the embodiment shown is also formed from a ¼" formed steel plate, and which may be coupled (by welding, for example) to the second portion 166 at an end 174 of the second portion 166 opposite the end 170 of the first portion 164. The first fastening body 168 in the embodiment shown includes a flange 176 defining through-openings 178 and 180 that are sized to receive ½" bolts, and spaced apart flanges 182 and 184 coupled to and extending generally perpendicularly from the flange 176. The flange 182 defines a plurality of through-openings 186 and the flange 184 defines a plurality of through-openings 188. The through-openings 186 and 188 are also sized to receive ½" bolts in the embodiment shown.

Figure 4:
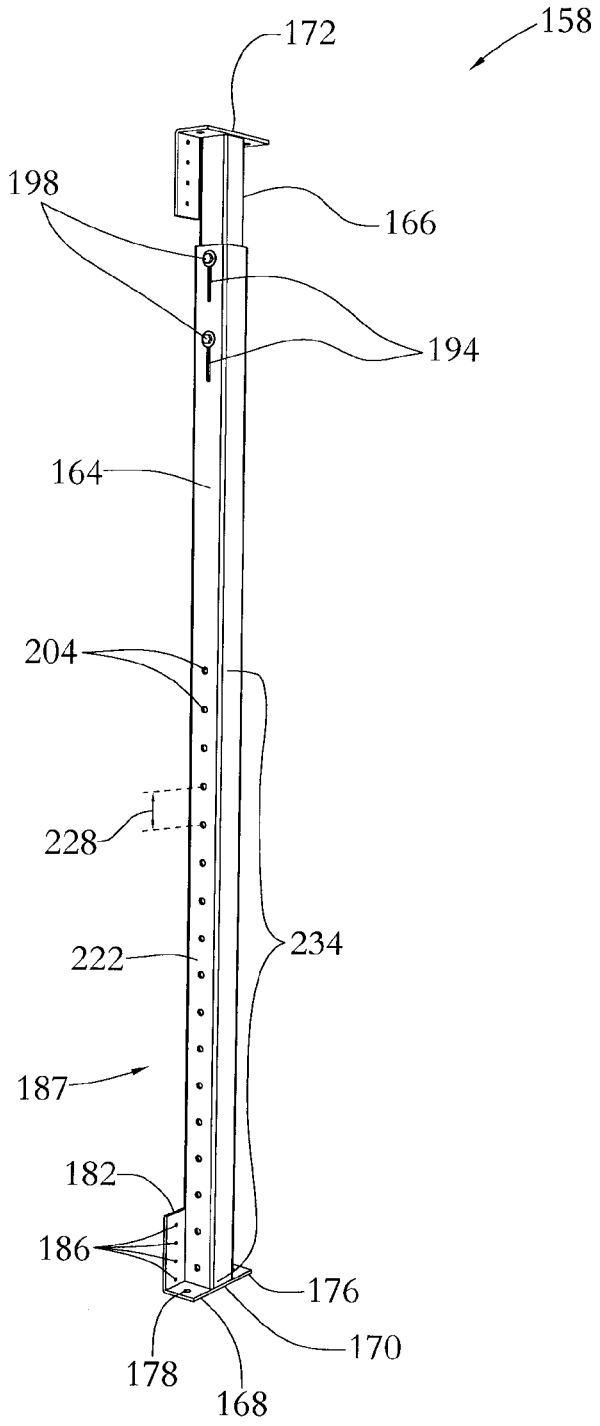
FIG. 4 is a left-side assembled perspective view of the support body of FIG. 2.
Figure 5:
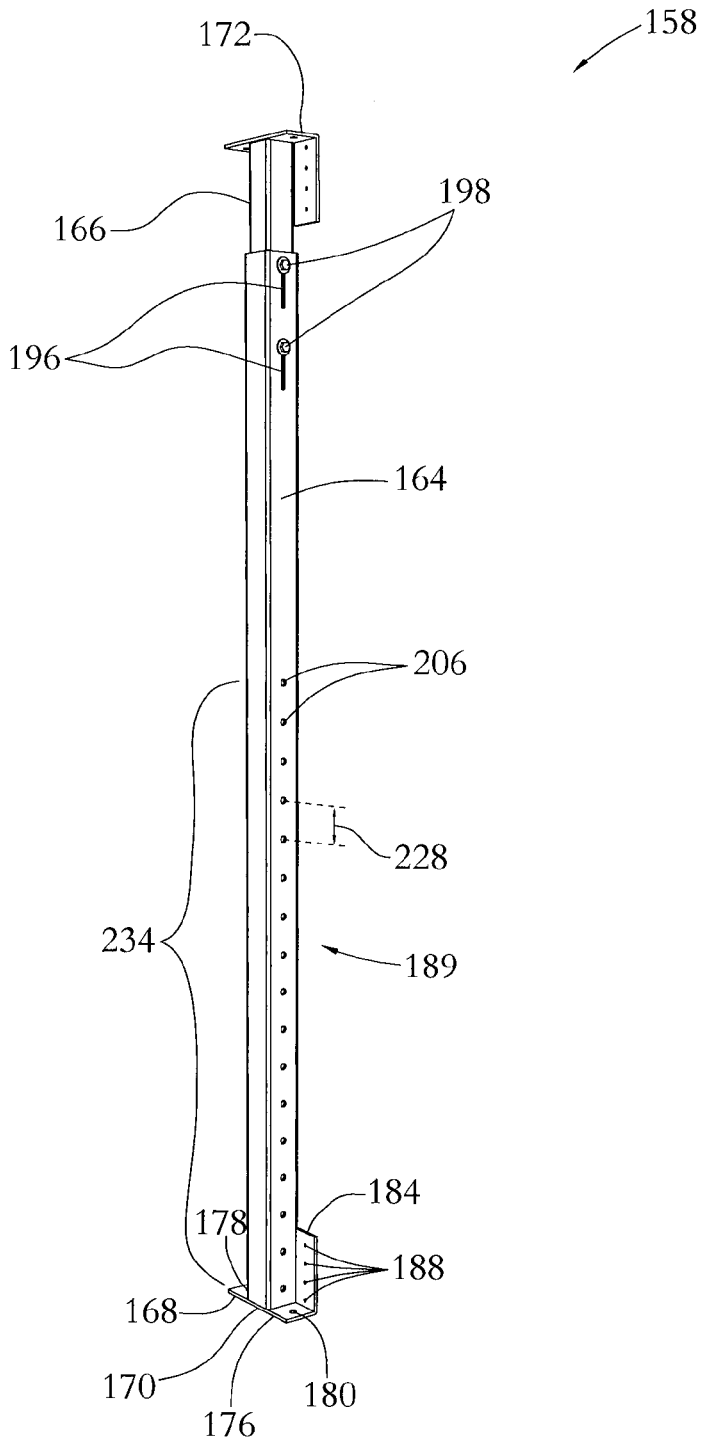
FIG. 5 is a right-side assembled perspective view of the support body of FIG. 2.
Figure 10:
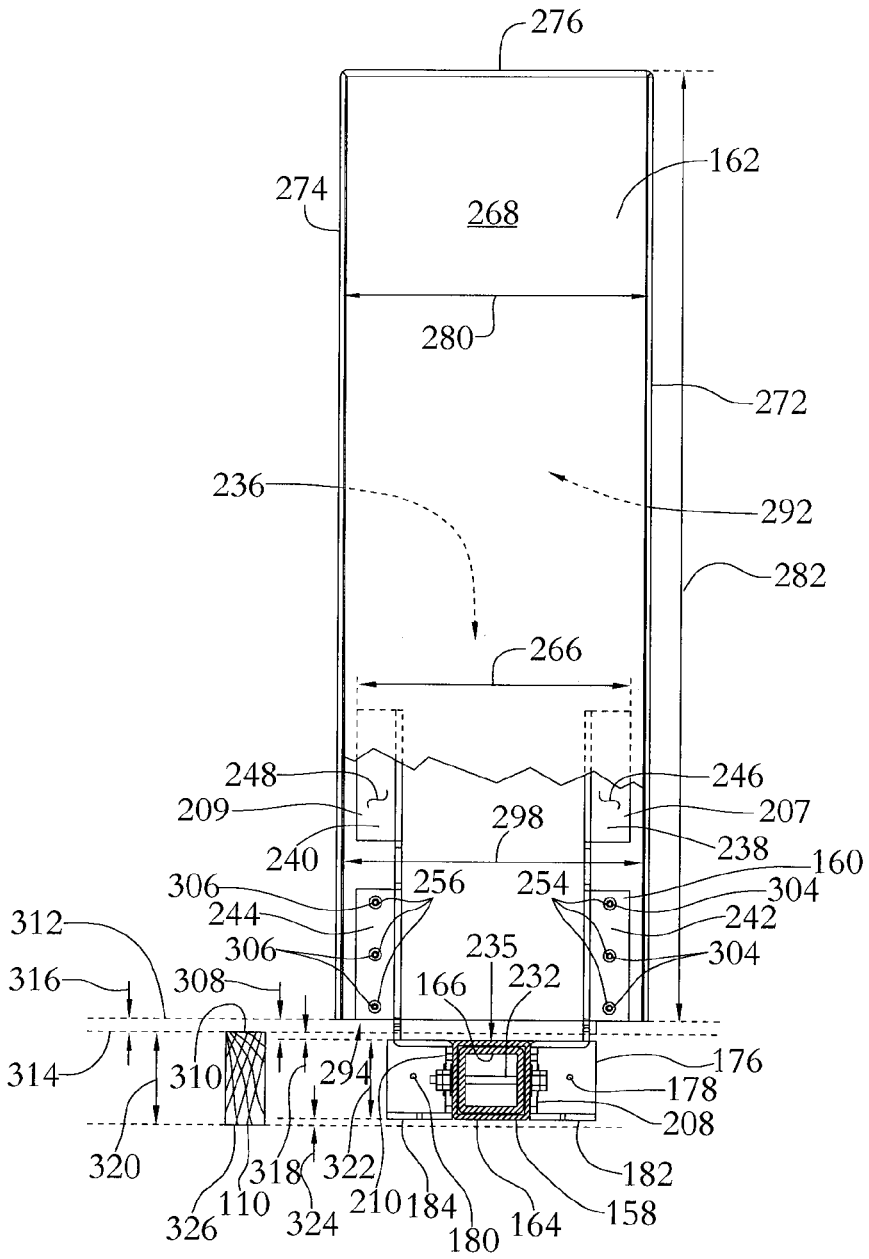
FIG. 10 is a cross-sectional view of a stair system of the wall assembly of FIG. 1, taken along the line X-X shown in FIG. 1.

Referring to FIGS. 4 and 5, in the embodiment shown, the first fastening body 168 is coupled to the first portion 164 proximate the end 170 of the first portion 164 such that the flanges 182 and 184 are generally coplanar with and abut a rear wall of the first portion 164 as also shown in FIG. 10. When the first fastening body 168 is coupled to the first portion 164 proximate the end 170 of the first portion 164, the flanges 182 and 184 in the embodiment shown extend away from the flange 176 and along the support body 158 generally adjacent opposite lateral sides shown generally at 187 and 189 respectively of the support body 158.

The second fastening body 172 is substantially the same as the first fastening body 168, except that in the embodiment shown, the second fastening body 172 includes a single flange 173 instead of the spaced apart flanges 182 and 184, and the second fastening body 172 is coupled to the second portion 166 proximate the end 174 such that the flange 173 abuts a rear wall of the second portion 166 and is generally coplanar with the flanges 182 and 184. The rear wall of the first portion 164 is thus generally coplanar with the flanges 173, 182, and 184, and therefore the rear wall of the first portion 164 and the flanges 173, 182, and 184 may all abut a generally planar surface such as a generally vertical concrete wall (not shown) for example.

The second fastening body 172 is thus spaced apart from the first fastening body 168 when the first fastening body 168 is coupled to the first portion 164 proximate the end 170 of the first portion 164 and when the second fastening body 172 is coupled to the second portion 166 at the end 174 of the second portion 166. Further, the first and second fastening bodies 168 and 172 are configured to fasten the support body 158 to respective spaced apart regions of the wall 102 (shown in FIG. 1), in the embodiment shown by receiving fasteners through the various through-openings of the first and second fastening bodies 168 and 172 and into structural regions of the wall 102, such as regions of the bottom and top plates 106 and 108 adjacent the first and second fastening bodies 168 and 172.

Referring to FIGS. 2, 3, 4, and 5, the second portion 166 in the embodiment shown defines through-openings 190 spaced apart from each other longitudinally along the lateral side 187, and through-openings 192 spaced apart from each other longitudinally along the lateral side 189 and laterally opposite respective ones of the through-openings 190. In the embodiment shown, the through-openings 190 and 192 are sized to receive ½" bolts. Further, the embodiment shown includes 10 through-openings 190 that are respectively spaced about 11, 14, 17, 20, 23, 26, 29, 32, 35, and 38 inches (or about 27.9, 35.6, 43.2, 50.8, 58.4, 66, 73.7, 81.3, 88.9, and 96.5 centimeters) from the end 174, and the embodiment shown also includes 10 through-openings 192 that are also respectively spaced about 11, 14, 17, 20, 23, 26, 29, 32, 35, and 38 inches (or about 27.9, 35.6, 43.2, 50.8, 58.4, 66, 73.7, 81.3, 88.9, and 96.5 centimeters) from the end 174. Alternative embodiments may include more or fewer through-openings 190, which may be spaced from the end 174 differently from the embodiment shown.

Further, in the embodiment shown, the first portion 164 defines elongate through-openings 194 spaced apart from each other longitudinally and extending longitudinally along the lateral side 187, and elongate through-openings 196 spaced apart from each other longitudinally and extending longitudinally along the lateral side 189 and laterally opposite respective ones of the through-openings 194. In the embodiment shown, the through-openings 194 and 196 are sized to receive ½" bolts, and centers of the through-openings 194 and 196 are about 92 and 98 inches (or about 233.7 and 248.9 centimeters) from the end 170 of the first portion 164. Therefore, centers of the through-openings 194 are spaced apart from each other by about 6 inches (or about 15.2 centimeters), and centers of the through-openings 196 are spaced apart from each other by about 6 inches (or about 15.2 centimeters).

The second portion 166 is telescopically receivable in the first portion 164, and FIGS. 4 and 5 show the second portion 166 telescopically received in the first portion 164. When the second portion 166 is telescopically received within the first portion 164, the second portion 166 may be moved longitudinally within the first portion 164. As the second portion 166 is moved longitudinally within the first portion 164, ones of the through-openings 190 become aligned with respective ones of the through-openings 194, and ones of the through-openings 192 become aligned with respective ones of the through-openings 196, such that the through-openings can receive fasteners 198 to fasten the second portion 166 in a longitudinal position telescopically within the first portion 164, the fastened position defined by which of the through-openings 190 and 192 are aligned with the through-openings 194 and 196, and by positions at which the fasteners 198 are fastened within the through-openings 194 and 196. The fasteners 198 may include a lock nut, such as a NyLock™ or a Stover™ lock nut, for example. Alternatively, the fasteners 198 may include bolts coated with Loctite™ Epoxy Heavy Duty thread locker and nuts threaded onto the bolts, for example.

In the embodiment shown, the through-openings 190 and 192 are spaced apart by a spacing distance 200 of about 3 inches (or about 7.6 centimeters), and the through-openings 194 and 196 extend longitudinally along the first portion 164 along a distance 202 that is also about 3 inches (or about 7.6 centimeters). In the embodiment shown, because the distance 202 is equal to the spacing distance 200, respective ones of the through openings 190 will be aligned with the through openings 194 and respective ones of the through openings 192 will be aligned with the through openings 196 in any position over a range of longitudinal positions of the second portion 166 telescopically within the first portion 164, and the second portion 166 may thus be fastened in any longitudinal position telescopically within the first portion 164 within that range, allowing the support body 158 to be adjusted in length to vary a distance separating the first fastening body 168 and the second fastening body 172 to accommodate for differences in height between the bottom plates 106 and the top plates 108 in the embodiment shown in FIG. 1. In one embodiment, the range of longitudinal positions over which the second portion 166 may be fastened telescopically within the first portion 164 may extend over about 12 inches (or about 30.5 centimeters), and a center of the range may cause the first fastening body 168 and the second fastening body 172 to abut the top plates 108 and the bottom plates 106 respectively when the top plates 108 and the bottom plates 106 are separated by a distance of about 8 feet (or about 244 centimeters).

As shown in FIG. 1, the first and second fastening bodies 168 and 172 each include through-holes for receiving generally vertical and generally horizontal fasteners, and thus at each of the first and second fastening bodies 168 and 172 in the embodiment shown, the support body 158 can be fastened to a structural region of the wall having one or both of a generally horizontal and a generally vertical surface. For example, in the embodiment of FIG. 1, the through-openings 178 and 180 (shown in FIGS. 2 to 5) on the first fastening body 168 are generally vertical, and thus can receive generally vertical fasteners to fasten the support body 158 at the first fastening body 168 to the bottom plates 106 against a generally horizontal surface of the bottom plates 106. Similarly, generally vertical through-openings of the second fastening body 172 in the embodiment of FIG. 1 can receive generally vertical fasteners to fasten the support body 158 at the second fastening body 172 to the top plates 108 against a generally horizontal surface of the top plates 108. The support body 158 is thus mountable in the wall 102.

However, in alternative embodiments, the support body 158 may be fastened at each of the first and second fastening bodies 168 and 172 to a generally vertical concrete wall (not shown). In such embodiments, the generally horizontal through-openings of the first and second fastening bodies 168 and 172 (such as the through-openings 186 and 188 of the first fastening body 168 shown in FIGS. 2 to 5 for example) may receive generally horizontal fasteners to fasten the support body 158 at the first and second fastening bodies 168 and 172 to the concrete wall at generally vertical surfaces of the concrete wall. Further, in some embodiments, the generally vertical through-openings of the first and second fastening bodies 168 and 172 (such as the through-openings 178 and 180 of the first fastening body 168 shown in FIGS. 2 to 5 for example) may receive generally vertical fasteners to fasten the support body 158 at one or both of the first and second fastening bodies 168 and 172 to generally horizontal surfaces near the concrete wall, such as a concrete floor or ceiling for example.

In embodiments where the support body 158 is fastened to a concrete wall or to a concrete floor, the fasteners may include threaded rods coated in an adhesive such as Hilti™ HIT-RE 500 epoxy, for example, and embedded in holes drilled in the concrete. In such embodiments, a washer, and a nut treated with Loctite™ Epoxy Heavy Duty thread locker and tightened to an appropriate torque, may be applied to each of the threaded rods after the epoxy has cured. More generally, support bodies such as the support body 158 may be fastened to various structural regions of various walls, including brick or other masonry, steel studs, or insulating concrete forms ("ICF"), for example.

Referring to FIGS. 2, 3, 4, and 5, the first portion 164 in the embodiment shown also defines a plurality of through-openings 204 spaced apart from each other longitudinally along the lateral side 187, and a plurality of through-openings 206 spaced apart from each other longitudinally along the lateral side 189 and laterally opposite respective ones of the through-openings 204. In the embodiment shown, the through-openings 204 and 206 are sized to receive ½" bolts. Further, the embodiment shown includes 22 through-openings 204 that are respectively spaced about 1.87, 4.87, 7.87, 10.87, 13.87, 16.87, 19.87, 22.87, 25.87, 28.87, 31.87, 34.87, 37.87, 40.87, 43.87, 46.87, 49.87, 52.87, 55.87, 58.87, 61.87, and 64.87 inches (or about 4.7, 12.4, 20, 27.6, 35.2, 42.8, 50.5, 58.1, 65.7, 73.3, 80.9, 88.6, 96.2, 103.8, 111.4, 119, 126.7, 134.3, 141.9, 149.5, 157.1, and 164.8 centimeters) from the end 170. The embodiment shown also includes 22 through-openings 206 that are also respectively spaced about 1.87, 4.87, 7.87, 10.87, 13.87, 16.87, 19.87, 22.87, 25.87, 28.87, 31.87, 34.87, 37.87, 40.87, 43.87, 46.87, 49.87, 52.87, 55.87, 58.87, 61.87, and 64.87 inches (or about 4.7, 12.4, 20, 27.6, 35.2, 42.8, 50.5, 58.1, 65.7, 73.3, 80.9, 88.6, 96.2, 103.8, 111.4, 119, 126.7, 134.3, 141.9, 149.5, 157.1, and 164.8 centimeters) from the end 170. Alternative embodiments may include more or fewer through-openings 206, which may be spaced from the end 170 differently from the embodiment shown.

Figure 6:
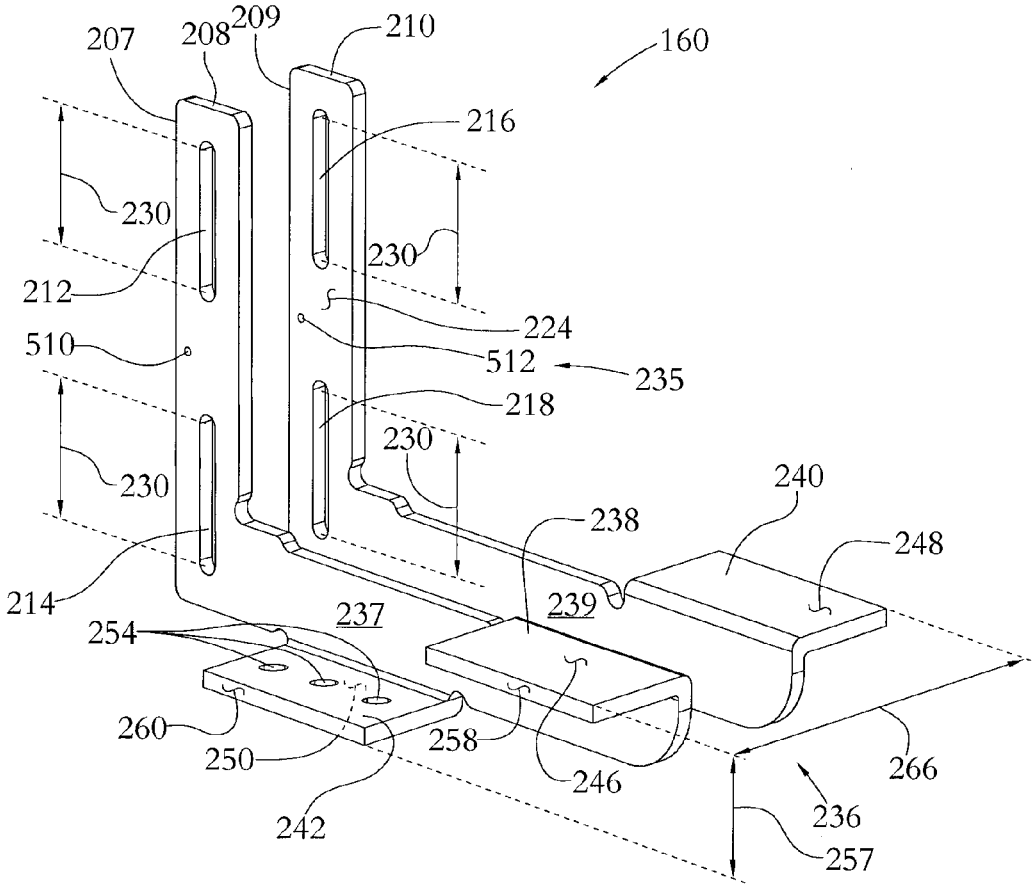
FIG. 6 is a left-side perspective view of a mounting apparatus of the wall assembly of FIG. 1.
Figure 7:
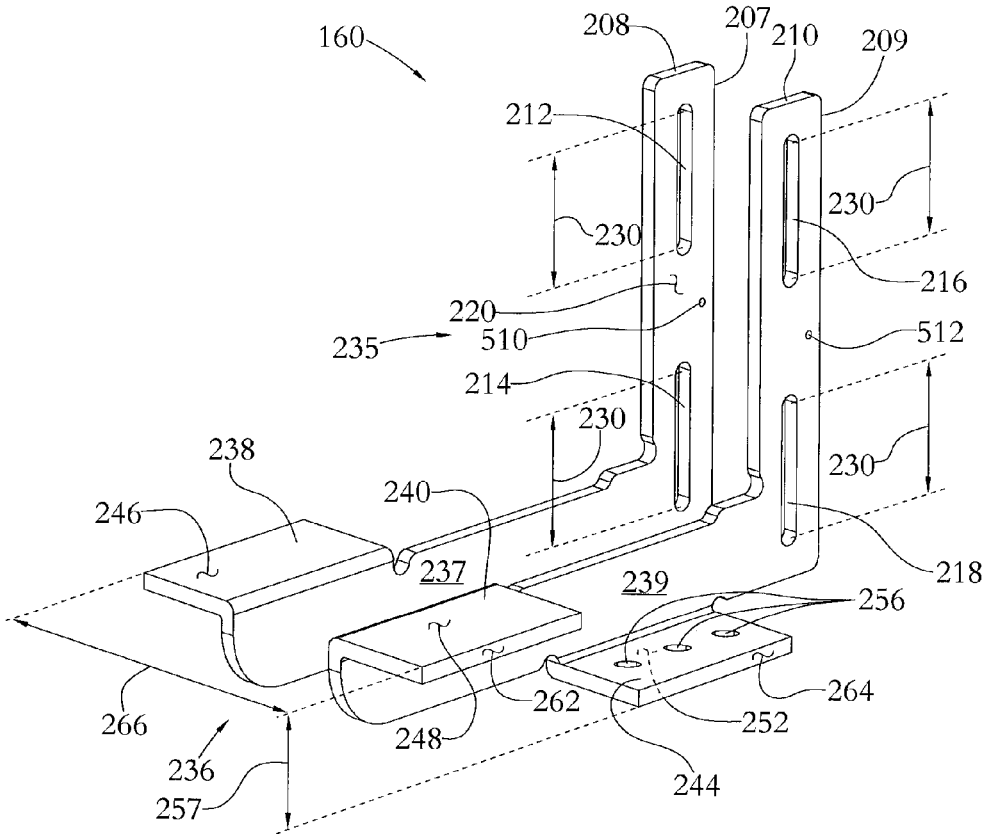
FIG. 7 is a right-side perspective view of the mounting apparatus of FIG. 6.

Referring to FIGS. 6 and 7, the mounting apparatus 160 in the embodiment shown includes a mounting body 207 having a connecting flange 208, and a mounting body 209 having a connecting flange 210. FIGS. 6 and 7 illustrate the mounting bodies 207 and 209 positioned such that the connecting flanges 208 and 210 are generally parallel and spaced apart. The connecting flange 208 defines elongate through-openings 212 and 214 extending generally collinearly and generally longitudinally along the connecting flange 208, and the connecting flange 210 defines elongate through-openings 216 and 218 extending generally collinearly and generally longitudinally along the connecting flange 210. In use, an inner surface 220 of the connecting flange 208 may be positioned adjacent a side surface 222 on the lateral side 187 (shown in FIG. 2) of the first portion 164, and an inner surface 224 of the connecting flange 210 may be positioned adjacent a side surface 226 on the lateral side 189 (shown in FIG. 3) of the first portion 164. Further, when the inner surface 220 is positioned adjacent the side surface 222 and when the inner surface 224 is positioned against the side surface 226, the through-openings 212 and 214 are adjacent respective ones of the plurality of through-openings 204 (shown in FIGS. 2 and 4), and the through-openings 216 and 218 are positioned adjacent respective ones of the plurality of through-openings 206 (shown in FIGS. 3 and 5).

Referring to FIGS. 4, 5, 6, and 7, the through-openings 204 and 206 in the embodiment shown are separated by a longitudinal spacing distance 228 of about 3 inches (or about 7.6 centimeters), and the through-openings 212, 214, 216, and 218 have longitudinal lengths 230 that are also about 3 inches (or about 7.6 centimeters). Accordingly, a fastener (such as the fastener 232 shown in FIG. 1) can pass through the through-opening 212, a first one of the plurality of through-openings 204, a first one of the plurality of through-openings 206 opposite the first one of the plurality of through-openings 204, and the through-opening 216 to mount the mounting apparatus 160 to the first portion 164 of the support body 158. Further, another fastener (not shown) may pass through the through-opening 214, a second one of the plurality of through-openings 204, a second one of the plurality of through-openings 206 opposite the second one of the plurality of through-openings 204, and the through-opening 218 further to mount the mounting apparatus 160 to the first portion 164 of the support body 158. Such fasteners may also include a lock nut, such as a NyLock™ or a Stover™ lock nut, or bolts coated with Loctite™ Epoxy Heavy Duty thread locker and nuts threaded onto the bolts, for example.

Because the longitudinal lengths 230 in the embodiment shown are equal to the longitudinal spacing distance 228, the connecting flanges 208 and 210 allow the mounting apparatus 160 to be connected to the first portion 164 of the support body 158 in a desired position in a range of positions defined by the pluralities of through-openings 204 and 206. The through-openings 204 and 206 thus define a connecting region 234 along the support body 158 along which the connecting flanges 208 and 210 may be connected as described above, and the connecting flanges 208 and 210 in the embodiment shown thus function as a connector shown generally at 235 and connectable to the connecting region 234 of the support body 158 in any one of a plurality of different positions continuously available along the connecting region 234 of the support body 158. In the embodiment shown, the connecting region 234 is between the first and second fastening bodies 168 and 172, and the connector 235 is connectable to the connecting region 234 of the support body 158 at locations defined by the through-openings 204 and 206. The through-openings 204 and 206 in the embodiment shown thus define spaced apart connection locations on the connecting region 234 of the support body 158.

Further, in the embodiment shown, the connecting flanges 208 and 210 define through-openings 510 and 512 respectively for receiving additional fasteners to fasten the mounting apparatus 160 to the connecting region 234 of the support body 158. Because the through-openings 212, 214, 216, and 218 are elongate having the longitudinal lengths 230, there is a possibility that the mounting apparatus 160 could slide under a load along the connecting region 234 of the support body 158 if fasteners in the through-openings 212, 214, 216, and 218 are not sufficiently tight. Therefore, in some embodiments, once the mounting apparatus 160 is fastened to the connecting region 234 of the support body 158 using fasteners in the through-openings 212, 214, 216, and 218, additional holes (not shown) may be drilled in the connecting region 234 of the support body 158 at locations of the through-openings 510 and 512 on the connecting region 234 of the support body 158, and the mounting apparatus 160 may be additionally fastened to the connecting region 234 of the support body 158, for example by passing a #10 Tek™ screw through each of the through-openings 510 and 512 and threading the #10 Tek™ screws into the holes drilled in the connecting region 234 of the support body 158 at the locations of the through-openings 510 and 512.

Referring to FIGS. 6 and 7, the mounting apparatus 160 also includes a holder shown generally at 236 and extending generally perpendicularly to the connector 235. The holder 236 includes a holding projection 237 on the mounting body 207, which extends generally perpendicularly from the connecting flange 208 and defines an upper flange 238 and a lower flange 242. The holder 236 also includes holding projection 239 on the mounting body 209, which extends generally perpendicularly from the connecting flange 210 and defines an upper flange 240 and a lower flange 244. The upper flanges 238 and 240 have generally coplanar upper contact surfaces 246 and 248 respectively, and the lower flanges 242 and 244 have generally coplanar lower contact surfaces 250 and 252 respectively. Further, the lower flange 242 defines a plurality of through-openings 254 and the lower flange 244 defines a plurality of through-openings 256. A plane including the upper contact surfaces 246 and 248 is spaced apart from a plane including the lower contact surfaces 250 and 252 by a height 257 of the holder 236. Further, the upper and lower flanges 238 and 242 include generally coplanar outer surfaces 258 and 260, and the upper and lower flanges 240 and 244 include respective generally coplanar outer surfaces 262 and 264. Further, a plane including the outer surfaces 258 and 260 is spaced apart from a plane including the outer surfaces 262 and 264 by a depth 266 of the holder 236.

Figure 8:
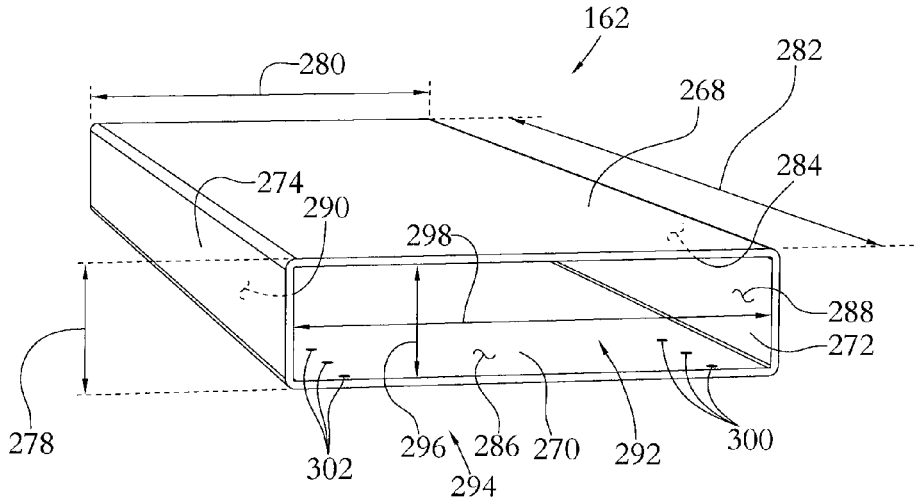
FIG. 8 is an end perspective view of an open end of a stair body of the wall assembly of FIG. 1.
Figure 9:
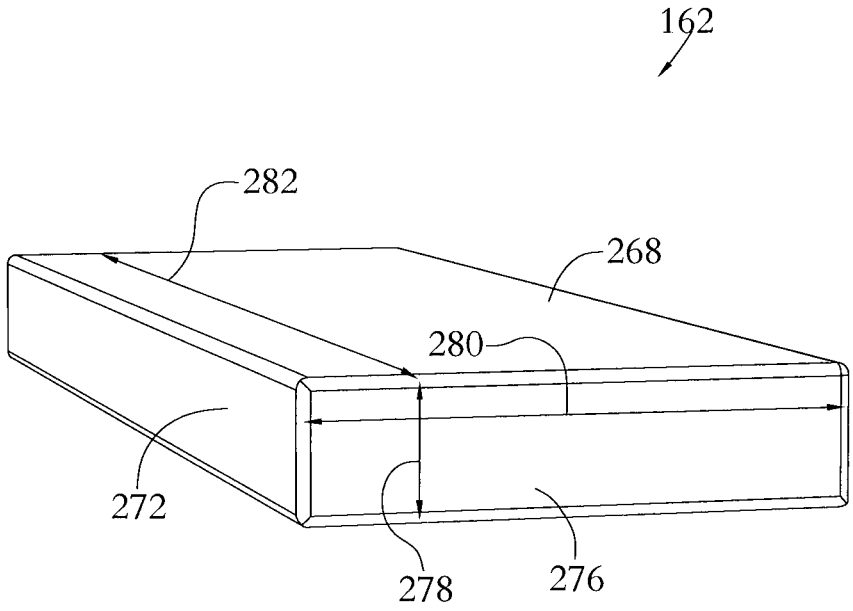
FIG. 9 is an end perspective view of a free end opposite the open end of the stair body of FIG. 8.

Referring to FIGS. 8 and 9, the stair body 162 is generally rectangular and includes generally rectangular, generally planar, and generally parallel top and bottom panels 268 and 270, generally rectangular, generally planar, and generally parallel side panels 272 and 274 extending between the top and bottom panels 268 and 270, and a generally rectangular and generally planar end panel 276 extending between the top and bottom panels 268 and 270 and between the side panels 272 and 274. In some embodiments, the stair body 162 may be formed of hollow steel section. In the embodiment shown, the panels 268, 270, 272, and 274 are formed from steel tubing having a thickness of about ¼ inches (or about 0.64 centimeters), and the end panel 276 is a steel plate having a thickness of about ¼ inches (or about 0.64 centimeters) that is welded to the steel tubing and ground clean with rounded edges. The stair body has an external height 278, which in the embodiment shown is about 3 inches (or about 7.6 centimeters), an external tread depth 280, which in the embodiment shown is about 12 inches (or about 30.5 centimeters), and an external width 282, which in the embodiment shown is about 36 inches (or about 91.4 centimeters).

In alternative embodiments, the external heights, external widths, and external tread depths of stair bodies may differ from those of the embodiment shown. For example, the external height of stair bodies of alternative embodiments may be about 4 or about 5 inches (or about 10.2 or about 12.7 centimeters). Also for example, the external widths of stair bodies of alternative embodiments may be longer than about 36 inches (or about 91.4 centimeters). In embodiments (such as the embodiment shown in FIG. 20) where the first portion of the support body is formed from steel tubing having a thickness of about ⅜ inches (or about 0.95 centimeters), a generally rectangular external width of about 3 inches (or about 7.6 centimeters), a generally rectangular external depth of about 4 inches (or about 10.2 centimeters), and a length of about 101 inches (or about 256.5 centimeters), and where the second portion of the support body is formed from steel tubing having a thickness of about ¼ inches (or about 0.64 centimeters), a generally rectangular external width of about 2.5 inches (or about 6.4 centimeters), a generally rectangular external depth of about 3.5 inches (or about 8.9 centimeters), and a length of about 51.5 inches (or about 130.8 centimeters), it has been found that the maximum external width of a stair body that can be safely supported is about 40 to about 42 inches (or about 101.6 to about 106.7 centimeters). However, in alternative embodiments, for example in embodiments (not shown) where the support body is formed from steel tubing having a generally rectangular external width of about 5 inches (or about 12.7 centimeters) and a generally rectangular external depth of about 6 inches (or about 15.2 centimeters), the maximum external width that can be supported may be as high as about 72 inches (or about 183 centimeters). In such embodiments, the remaining components such as the stair bodies, the mounting apparatuses, and the fasteners for example may all be scaled up in size to accommodate additional torque from the longer cantilever resulting from increased external widths of the stair bodies. Further, although the support bodies shown in FIG. 20 have different dimensions from the support body 158 shown in FIGS. 2 to 5, in general the support bodies described herein may be substituted for one another in various embodiments.

Still referring to FIGS. 8 and 9, the top panel 268 has an inner surface 284, the bottom panel 270 has an inner surface 286 opposite the inner surface 284, the side panel 272 has an inner surface 288, and the side panel 274 has an inner surface 290 opposite the inner surface 288. The inner surfaces 284, 286, 288, and 290 define a cavity shown generally at 292 in the stair body 162, and the cavity 292 is open at an open end shown generally at 294 and opposite the end panel 276. Further, the cavity 292 has an internal height 296 between the inner surfaces 284 and 286, and an internal depth 298 between the inner surfaces 288 and 290.

Referring to FIGS. 6, 7, and 8, the height 257 of the holder 236 is defined to fit tightly within the internal height 296, although in some embodiments, shims may be positioned between the holder 236 and the one or more inner surfaces of the cavity 292 of the stair body 162 to tighten the fit between the holder 236 and the stair body 162. Also in the embodiment shown, the depth 266 of the holder 236 fits within the internal depth 298 of the holder 236. In some embodiments, the depth 266 may fit tightly within the internal depth 298, and in other embodiments the depth 266 of the holder 236 may be smaller than the internal depth 298. The holder 236 is thus sized to be received slidably in the cavity 292 of the stair body 162 and the holder 236 is configured to hold the stair body 162 when the holder 236 is slidably received in the cavity 292. Further, the upper contact surfaces 246 and 248 and the lower contact surfaces 250 and 252 extend transversely and longitudinally relative to the holder 236 to prevent movement of the stair body 162 about the holder 236 when the holder 236 is received in the cavity 292 of the stair body 162.

Referring to FIG. 10, when the holder 236 is slidably received in the cavity 292 of the stair body 162, and when the connector 235 is connected to the connecting region 234 (shown in FIGS. 2 to 5) of the support body 158, the open end 294 can be spaced apart from the support body 158 by various distances that decrease as more of the holder 236 is received in the cavity 292 of the stair body 162. Therefore, in general, the holder 236 and the cavity 292 of the stair body 162 permit any spacing distance between the stair body 162 and the support body 158 that may be defined by the dimensions of the support body 158, the mounting apparatus 160, and the stair body 162, and by an amount of the holder 236 that may be slidably received in the cavity 292 of the stair body 162.

Referring back to FIG. 8, the bottom panel 270 defines a plurality of through-openings 300 proximate the side panel 272, and a plurality of through-openings 302 proximate the side panel 274. In the embodiment shown, the through-openings 300 and 302 are drilled with a countersink to receive ⅝" flathead fasteners. When the holder 236 is received in the cavity 292 of the stair body 162, the through-openings 254 (shown in FIG. 6) are aligned with the through-openings 300, and the through-openings 256 (shown in FIG. 7) are aligned with the through-openings 302. A plurality of fasteners (not shown) may be received through the through-openings 254 and 300, and another plurality of fasteners (not shown) may be received through the through-openings 256 and 302 to fasten the holder 236 to the stair body 162 when the holder 236 is received in the cavity 292.

Referring to FIG. 10, in the embodiment shown, the through-openings 254 and 256 and the through-openings 300 and 302 (shown in FIG. 8) are positioned such that when fasteners 304 are received through the through-openings 254 and 300 (shown in FIG. 8) and when fasteners 306 are received through the through-openings 256 and 302 (shown in FIG. 8), the stair body 162 may be fastened to the holder 236 such that the open end 294 of the stair body 162 is spaced apart from the support body 158 by a spacing distance 308. The fasteners 304 and 306 may include bolts and the through-openings 254 or 256 may be tapped or otherwise formed to have complementary threads to receive the fasteners 304 and 306 in threaded engagement. In alternative embodiments, the fasteners 304 and 306 may include bolts coated with Loctite™ Epoxy Heavy Duty thread locker and nuts threaded onto the bolts, for example. In such embodiments, the nuts may be fixed in position on the lower flanges 242 and 244, or adjustable in position on the lower flanges 242 and 244 but held to prevent rotation relative to the lower flanges 242 and 244, so that the fasteners 304 and 306 can be threaded into such nuts. In other alternative embodiments, the fasteners 304 and 306 may be omitted and the stair body 162 may be fastened to the holder 236 by a friction fit of the holder 236 (and one or more shims in some embodiments) in the cavity 292, or by adhesives or other means for holding the holder 236 in a desired position in the cavity 292.

In some embodiments, the stair body 162 may be manufactured and distributed with the through-openings 300 and 302 in predetermined positions, but the mounting apparatus 160 may be manufactured and distributed without any through-openings such as the through-openings 254 or 256. In such embodiments, once the support body 158 is fastened in the wall 102 and the mounting apparatus 160 is fastened to the connecting region 234 of the support body 158 as described above and shown in FIG. 1, for example, the holder 236 may be slidably received in the cavity 292 of the stair body 162, to a desired position, and the lower flanges 242 and 244 of the mounting apparatus 160 may be marked for drilling and tapping of the through-openings 254 and 256. The through-openings 254 and 256 may thus be determined after the support body 158 is fastened in the wall 102 and the mounting apparatus 160 is fastened to the connecting region 234 of the support body 158 to ensure that the holder 236 holds the stair body 162 in a desired position, with a desired spacing distance 308 for example, and with a desired orientation (such as a perpendicular orientation, for example) relative to an outer surface (not shown in FIG. 1) of the wall 102 (shown in FIG. 1).

The wall stud 110 (also shown in FIG. 1) is adjacent the stair system 130 and has a front surface 310 for supporting a wall panel such as a drywall panel (not shown), and a plane 312 including the open end 294 of the stair body 162 and a plane 314 including the front surface 310 of the wall stud 110 are generally parallel and spaced apart by a spacing distance 316 sufficient to receive such a wall panel. For example, in some embodiments, the wall panel may be a drywall panel having a thickness of about 0.5 inches (or about 1.3 centimeters), and the spacing distance 316 in some embodiments may be slightly more than about 0.5 inches (or about 1.3 centimeters). In general, in some embodiments, the spacing distance 316 may be more than a thickness of the wall panel to prevent damage to the wall panel that could be caused if movement of the stair body 162, for example in response to a load on the stair body 162, also caused the stair body 162 to contact the wall panel and cause corresponding movement of the wall panel. In the embodiment shown, the spacing distance 308 is greater than the spacing distance 316, and thus the spacing distance 308 between the open end 294 of the stair body 162 and the support body 158 is also sufficient to receive the wall panel.

Still referring to FIG. 10, in the embodiment shown the plane 314 is generally parallel to and spaced apart from the support body 158 by a spacing distance 318. In one embodiment, the spacing distance 318 may be about 0.25 inches (or about 6.4 millimeters). In some embodiments the spacing distance 318 may advantageously prevent damage to a wall panel (not shown) positioned between the support body 158 and the stair body 162 by preventing deflections of the support body 158, which may be caused by loads on the stair body 162 transferred to the support body 158 for example, from being transferred to the wall panel.

As indicated above, the wall stud 110 in the embodiment shown is a "2×4" dimensional lumber product having a width 320 of about 3.5 inches (or about 8.9 centimeters), and therefore in the embodiment shown the support body 158 has an external width 322 of about 3 inches (or about 7.6 centimeters), which is generally the maximum width of the support body 158 that enables the spacing distance 318 as described above and an approximately equal spacing distance 324 between the support body 158 and a plane including a rear surface 326 of the wall stud 110 opposite the front surface 310.

Figure 11:
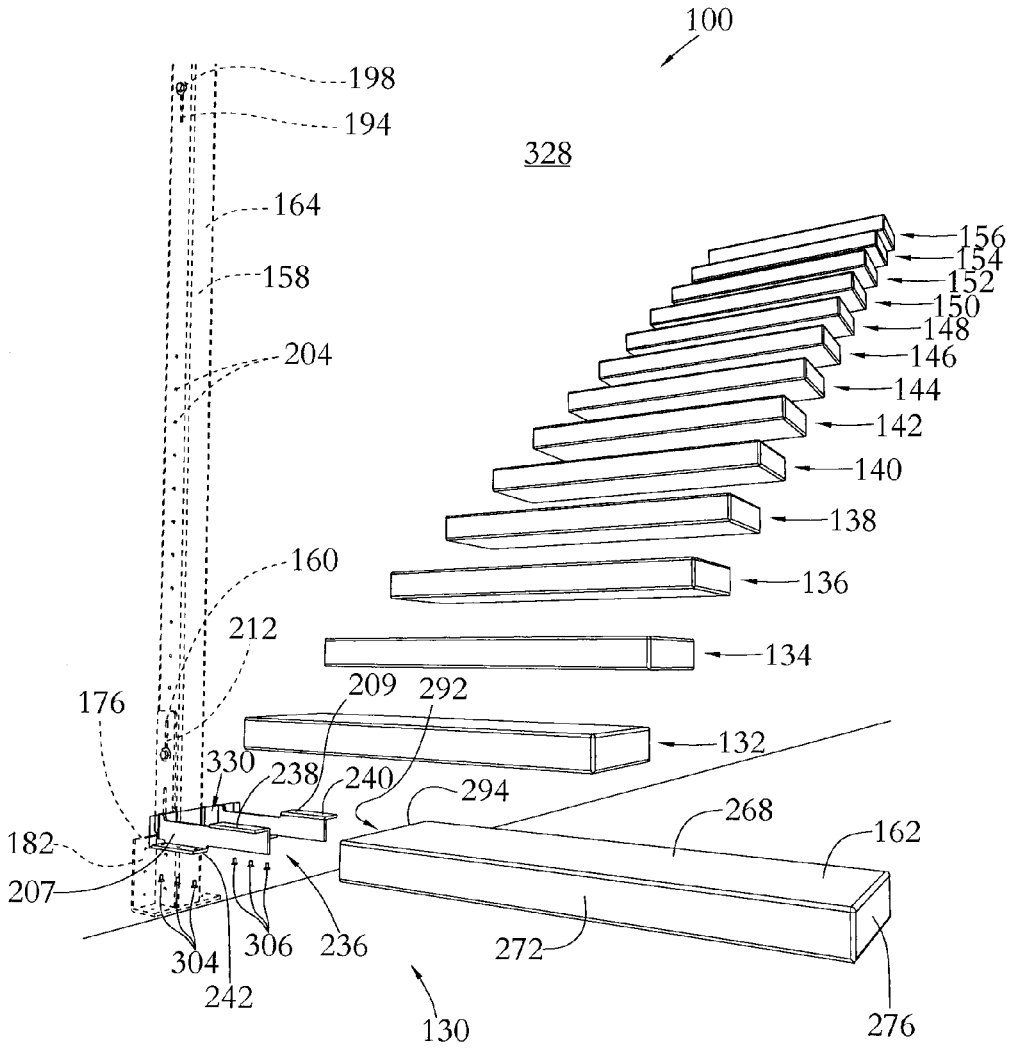
FIG. 11 is a perspective view of the wall assembly of FIG. 1, showing a wall panel included in the wall assembly of FIG. 1.

Referring to FIG. 11, the wall assembly 100 is shown with a wall panel 328, which may include one or more drywall panels for example, mounted on front surfaces (such as the front surface 310) of the wall studs of the wall assembly 100, which are shown in FIG. 1 as the wall studs 110, 112, 114, 116, 118, 120, 128, and 129. In general, the support bodies of the stair systems 130, 132, 134, 136, 138, 140, 142, 144, 146, 148, 150, 152, 154, and 156, such as the support body 158 of the stair system 130, are interspersed between the wall studs 110, 112, 114, 116, 118, 120, 128, and 129 and behind the wall panel 328, and such support bodies are thus mountable in the wall 102. In alternative embodiments where such support bodies are fastened to other regions of a wall, such as to concrete regions of a wall for example, such support bodies may still be referred to as "mountable in a wall" because such support bodies are mounted in a wall comprising such concrete regions and a wall panel similar to the wall panel 328.

Referring back to the embodiment shown in FIG. 11, a through-opening 330 is cut through the wall panel 328 to permit the holder 236 to pass through the wall panel 328 to be received in the cavity 292 of the stair body 162. In the embodiment shown, the through-opening 330 is large enough to permit the holder 236 to pass therethrough. In some embodiments, the through-opening 330 may be large enough to leave sufficient space surrounding the holder 236 such that if the holder 236 moves, for example in response to a load transferred from the stair body 162 to the holder 236, then the holder 236 will not contact the wall panel 328. In such embodiments, such space surrounding the holder 236 may prevent damage to the wall panel 328 that could be caused if such movement of the holder 236 also caused the holder 236 to contact the wall panel 328 and cause corresponding movement of the wall panel 328.

Further, in the embodiment shown, the through-opening 330 is small enough to be concealed substantially by the open end 294 of the stair body 162 when the holder 236 is received in the cavity 292 and when the open end 294 abuts the wall panel 328. As indicated above, in some embodiments, the spacing distance 316 (shown in FIG. 10) may be more than a thickness of the wall panel 328 to prevent damage to the wall panel 328, and in this embodiment, "concealed substantially" with reference to the through-opening 330 may refer to concealing the through-opening 330 but for any amount by which the spacing distance 316 may exceed the thickness of the wall panel 328 to prevent damage to the wall panel 328. Further, when the holder 236 is slidably received in the cavity 292 of the stair body 162 as shown in FIG. 11, the mounting apparatus 160 is concealed substantially behind the wall panel 328 and within the stair body 162, and again in this context "concealed substantially" may refer to concealing the mounting apparatus 160 but for any amount by which the spacing distance 316 may exceed the thickness of the wall panel 328 to prevent damage to the wall panel 328.

The stair systems 132, 134, 136, 138, 140, 142, 144, 146, 148, 150, and 152 are substantially the same as the stair system 130. However, as shown in FIG. 1, the stair systems 142, 144, 146, 148, and 150 include support bodies that are substantially the same as the support body 158 but inverted when compared to the support body 158 such that the connecting regions of the support bodies of the stair systems 142, 144, 146, 148, and 150 are on upper portions of such support bodies, whereas the connecting region 234 of the support body 158 is on a lower portion of the support body 158. Thus, in the embodiment shown, the connecting region 234 of the support body 158 extends about half of a height of the support body 158 such that the support body 158 may be oriented such that the connecting region 234 is on a lower portion of the support body 158 to support a stair generally in a lower half of the support body 158, or alternatively the support body 158 may be inverted such that the connecting region 234 is on an upper portion of the support body 158 to support a stair generally in the upper half of the support body 158.

Referring back to FIG. 1, the stair system 154 includes a support body 486 in the lower wall 104, and a support body 488 in the upper wall 105. The support bodies 486 and 488 are substantially the same as the support body 158 except that the support body 486 is inverted with respect to the support body 158 as described above. The stair system 154 also includes a mounting apparatus 490 and a stair body 491. The stair body 491 is substantially the same as the stair body 162.

Figure 12:
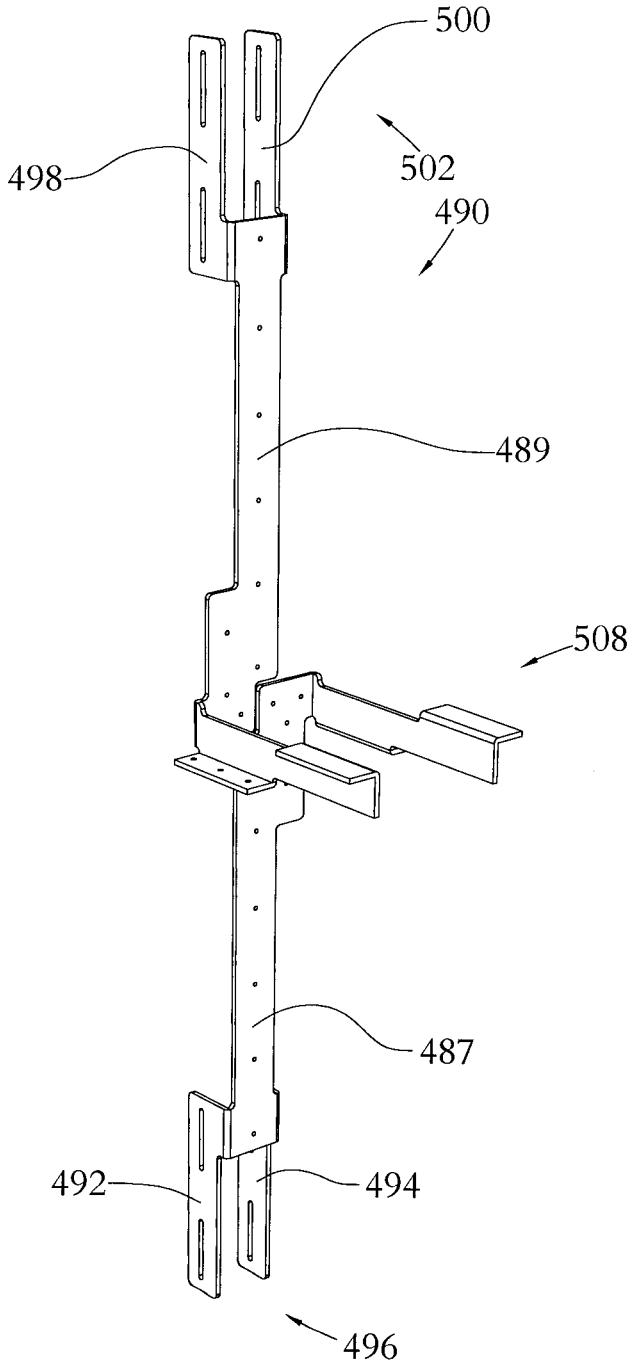
FIG. 12 is a perspective view of another mounting apparatus of the wall assembly of FIG. 1.

Referring to FIG. 12, the mounting apparatus 490 in the embodiment shown includes mounting bodies 487 and 489 that are identical but inverted with respect to each other. The mounting body 487 defines connecting flanges 492 and 494 at a first end shown generally at 496 of the mounting apparatus 490, and the mounting body 489 defines connecting flanges 498 and 500 at a second end 502 of the mounting apparatus 490 opposite the first end 496. The connecting flanges 492 and 494 are substantially the same as the connecting flanges 208 and 210 (shown in FIGS. 6 and 7, and function as a connector to connect the mounting apparatus 490 to a connecting region shown generally at 504 (and substantially the same as the connecting region 234) of the support body 488. Further, the connecting flanges 498 and 500 are also substantially the same as the connecting flanges 208 and 210 (shown in FIGS. 6 and 7), and also function as a connector for connecting the mounting apparatus 490 to a connecting region shown generally at 506 (and substantially the same as the connecting region 234) on the support body 486. Further, the mounting bodies 487 and 489 define a holder 508 of the mounting apparatus 490. The holder 508 is between the first and second ends 496 and 502 and includes contact surfaces that function generally similarly to the contact surfaces of the holder 236 (shown in FIGS. 6 and 7). The mounting apparatus 490 is thus connectable to the connecting regions 504 and 506 of the support bodies 486 and 488 respectively, and as a holder for holding the stair body 491 substantially as described above. The stair system 156 is substantially the same as the stair system 154.

Therefore, referring back to FIG. 11, the stair systems 130, 132, 134, 136, 138, 140, 142, 144, 146, 148, 150, 152, 154, and 156 collectively function as a staircase comprising stairs each single-cantilevered from a single end of the stair, leaving a free end of the stair opposite the cantilevered end of the stair either to be free of structural components or to support a guard, a railing, or both (not shown), for example, as may be desired or required in some jurisdictions. Further, and referring particularly to FIG. 1, the stairs of the staircase shown are cantilevered independently of the wall studs (such as the wall studs 110, 112, 114, 116, 118, 120, 128, and 129 shown in FIG. 1) and thus the wall panel 328 (shown in FIG. 11) in some embodiments may be unaffected by any deflections of the various support bodies as loads are applied to the various stairs. In some embodiments, isolating such deflections from the wall panel 328 may prevent damage to the wall panel that could result if such deflections were transferred to the wall panel 328. Still further, the stairs of the staircase shown are cantilevered independently of each other, which in some embodiments may avoid compounding imprecision from one stair system to another.

Figure 13:
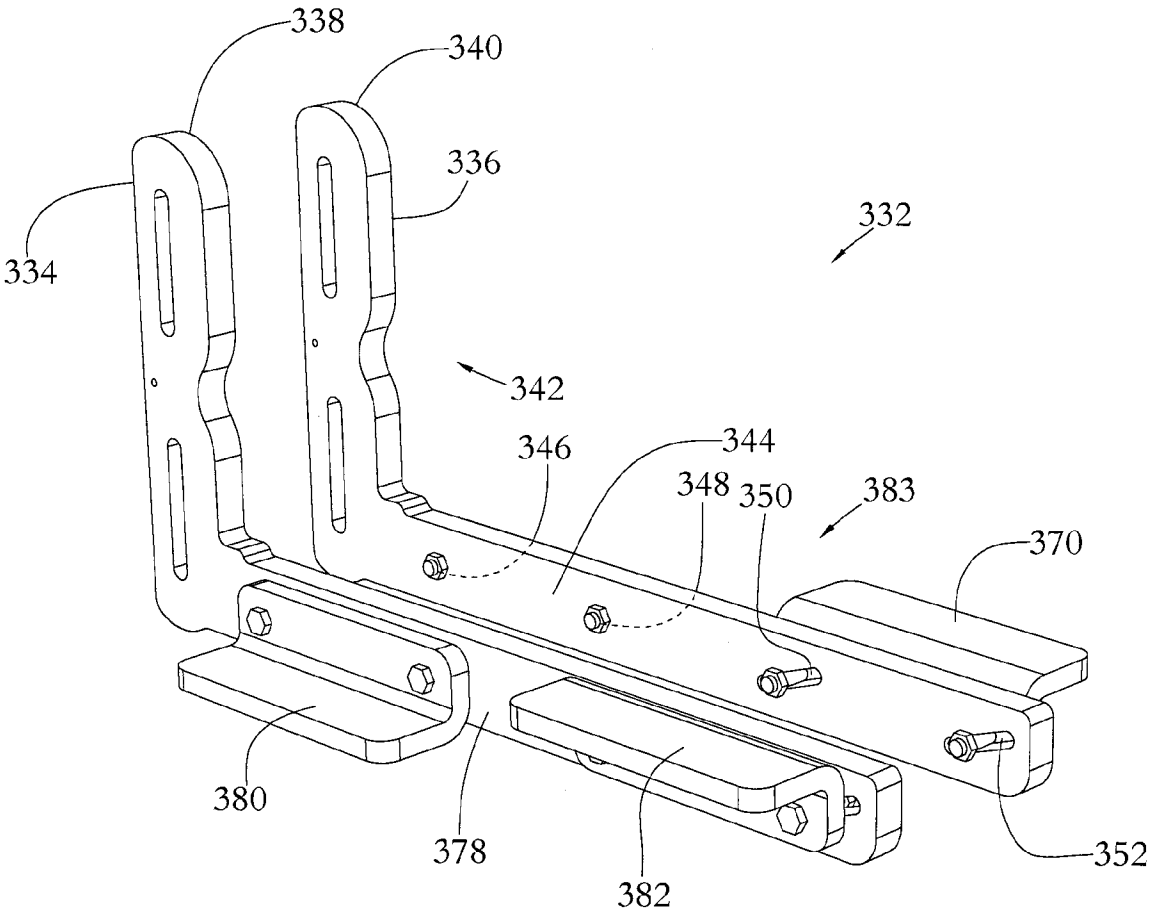
FIG. 13 is a left-side perspective view of a mounting apparatus according to another illustrative embodiment.
Figure 14:
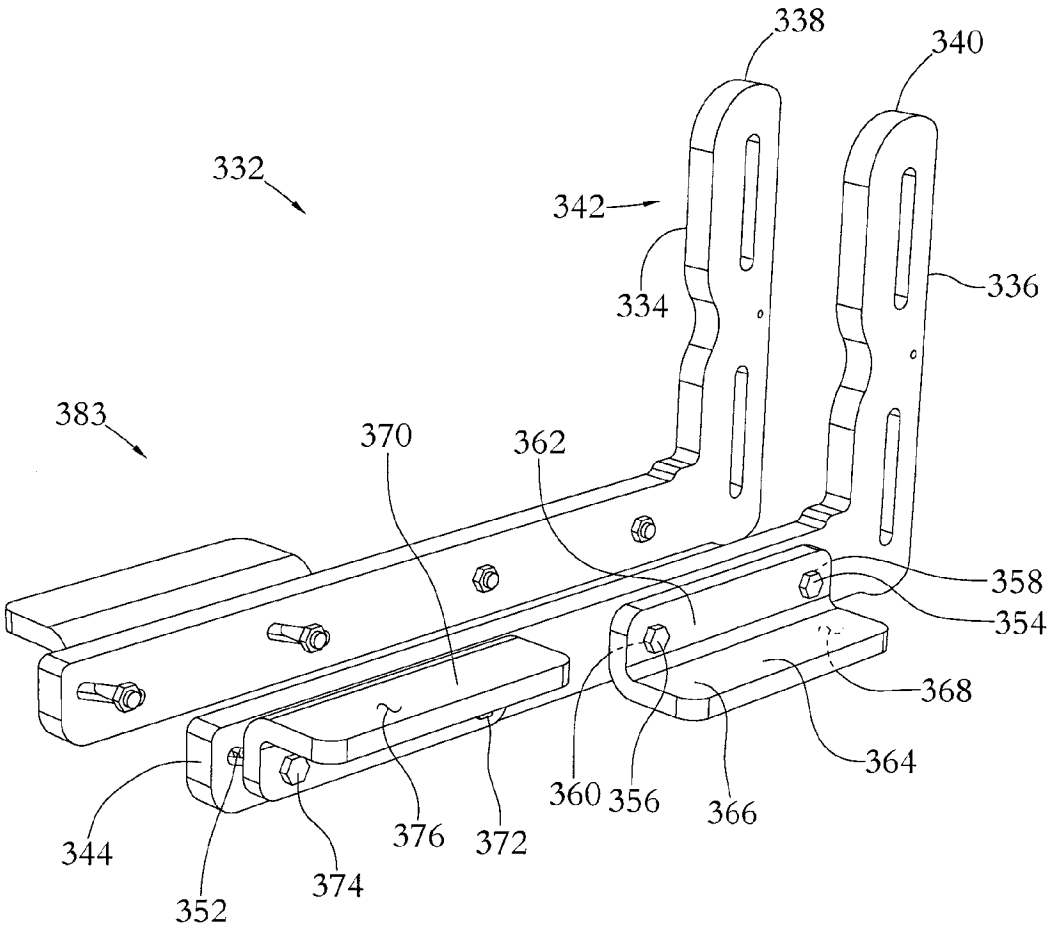
FIG. 14 is a right-side perspective view of the mounting apparatus of FIG. 13.

Referring to FIGS. 13 and 14, a mounting apparatus according to another illustrative embodiment is shown generally at 332 and includes mounting bodies 334 and 336 formed from ¾" steel plates in the embodiment shown. In the embodiment shown, the mounting bodies 334 and 336 are substantially the same and define respective connecting flanges 338 and 340 that function as a connector shown generally at 342 and connectable to a connecting region of a support body such as the connecting region 234 of the support body 158 (shown in FIGS. 2, 3, 4, and 5 for example) that functions substantially the same as the connector 235 shown in FIGS. 6 and 7.

Referring to FIGS. 13 and 14, the mounting body 336 also includes a holding projection 344 extending generally perpendicular to the connecting flange 338. In one embodiment, the angle between the connecting flange 340 and the holding projection 344 is 89.7°. The holding projection 344 defines through-openings 346, 348, 350, and 352. The through-openings 346 and 348 in the embodiment shown receive fasteners 354 and 356 respectively, which pass through through-openings 358 and 360 respectively on a fastening flange 362 of a lower holding body 364 to fasten the lower holding body 364 to the holding projection 344. The through-openings 358 and 360 have diameters of about 0.375 inches (or about 0.95 centimeters) in the embodiment shown. The lower holding body 364 in the embodiment shown is formed from a ½" steel plate and also includes a contact projection 366 extending generally perpendicular to the fastening flange 362. The contact projection 366 has a lower contact surface 368 on an opposite side of the contact projection 366 from the fastening flange 362, and when the lower holding body 364 is fastened to the holding projection 344 as shown in FIG. 14, the lower contact surface 368 functions substantially the same as the lower contact surface 252 shown in FIG. 7. Further, the through-openings 346, 348, 358, and 360 are generally circular, and thus the fasteners 354 and 356 fasten the lower holding body 364 to the holding projection 344 generally in a predetermined position.

Figure 15:
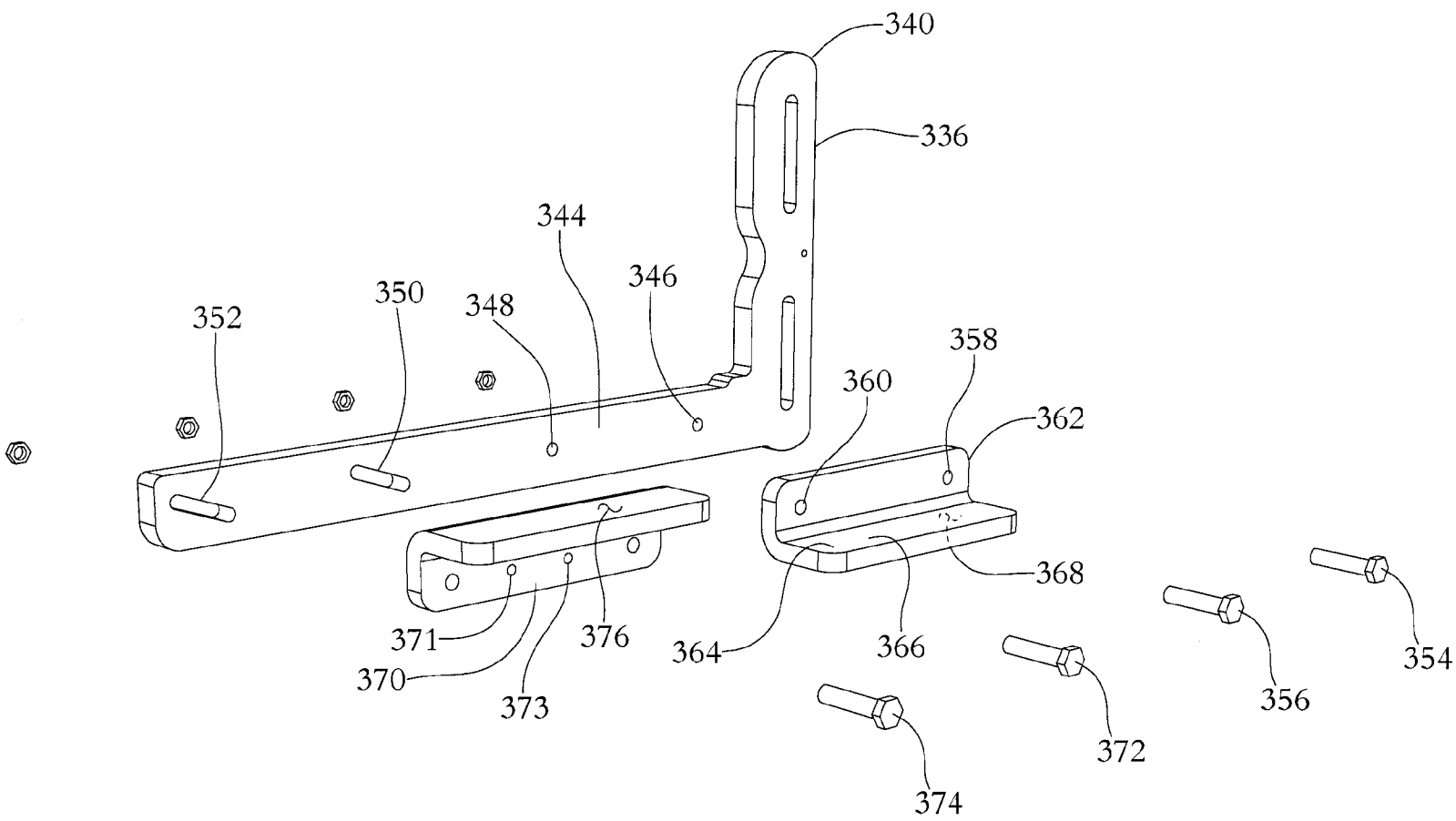
FIG. 15 is a right-side exploded perspective view of a mounting body, holding bodies, and fasteners of the mounting apparatus of FIG. 13.

Referring to FIGS. 13, 14, and 15, the mounting apparatus 332 also includes an upper holding body 370 that is substantially the same as the lower holding body 364 except that the upper holding body 370 is inverted with respect to the lower holding body 364 such that when the upper holding body 370 is fastened to the holding projection 344 using fasteners 372 and 374 through the through-openings 350 and 352 respectively, an upper contact surface 376 of the upper holding body 370 functions substantially the same as the upper contact surface 248 (shown in FIG. 7). Further, the upper holding body 370 defines through-openings 371 and 373 for receiving additional fasteners to fasten the upper holding body 370 to the holding projection 344 of the mounting body 336 as described below. The through-openings 371 and 373 have diameters of about 0.25 inches (or about 0.64 centimeters) in the embodiment shown.

Referring to FIG. 15, the through-openings 350 and 352 extend obliquely across the holding projection 344, and thus a position of the upper holding body 370 with respect to the holding projection 344 is adjustable by adjusting positions of the fasteners 372 and 374 along the through-openings 350 and 352 respectively. Therefore, a spacing distance between a plane including the lower contact surface 368 and a plane including the upper contact surface 376 may be adjusted, for example to accommodate variations in internal height of a stair body (such as the internal height 296 of the stair body 162 (shown in FIG. 8). Because the through-openings 350 and 352 are elongate, there is a possibility that the upper holding body 370 could slide under a load if fasteners in the through-openings 350 and 352 are not sufficiently tight. Therefore, in some embodiments, once the upper holding body 370 is fastened to the holding projection 344 of the mounting body 336 using fasteners in the through-openings 350 and 352, additional holes (not shown) may be drilled in the holding projection 344 of the mounting body 336 at locations of the through-openings 371 and 373 on the holding projection 344 of the mounting body 336, and the upper holding body 370 may be additionally fastened to the holding projection 344 of the mounting body 336, for example by passing a #10 Tek™ screw through each of the through-openings 371 and 373 and threading the #10 Tek™ screws into the holes drilled in the holding projection 344 of the mounting body 336 at the locations of the through-openings 371 and 373.

Referring back to FIG. 13, the mounting body 334 also includes a holding projection 378, and a lower holding body 380 and an upper holding body 382, which are substantially the same as the lower holding body 364 and the upper holding body 370 respectively, and which may be fastened to the holding projection 378 substantially as described above. The holding projections 344 and 378 and the holding bodies 364, 370, 380, and 382 thus function as a holder shown generally at 383 and substantially the same as the holder 236 (shown in FIGS. 6 and 7) except that upper contact surfaces of the holder 383 may be adjusted as described above. In alternative embodiments, the lower contact surfaces of the holder 383 may be adjusted instead of or in addition to the upper contact surfaces of the holder 383.

Figure 16:
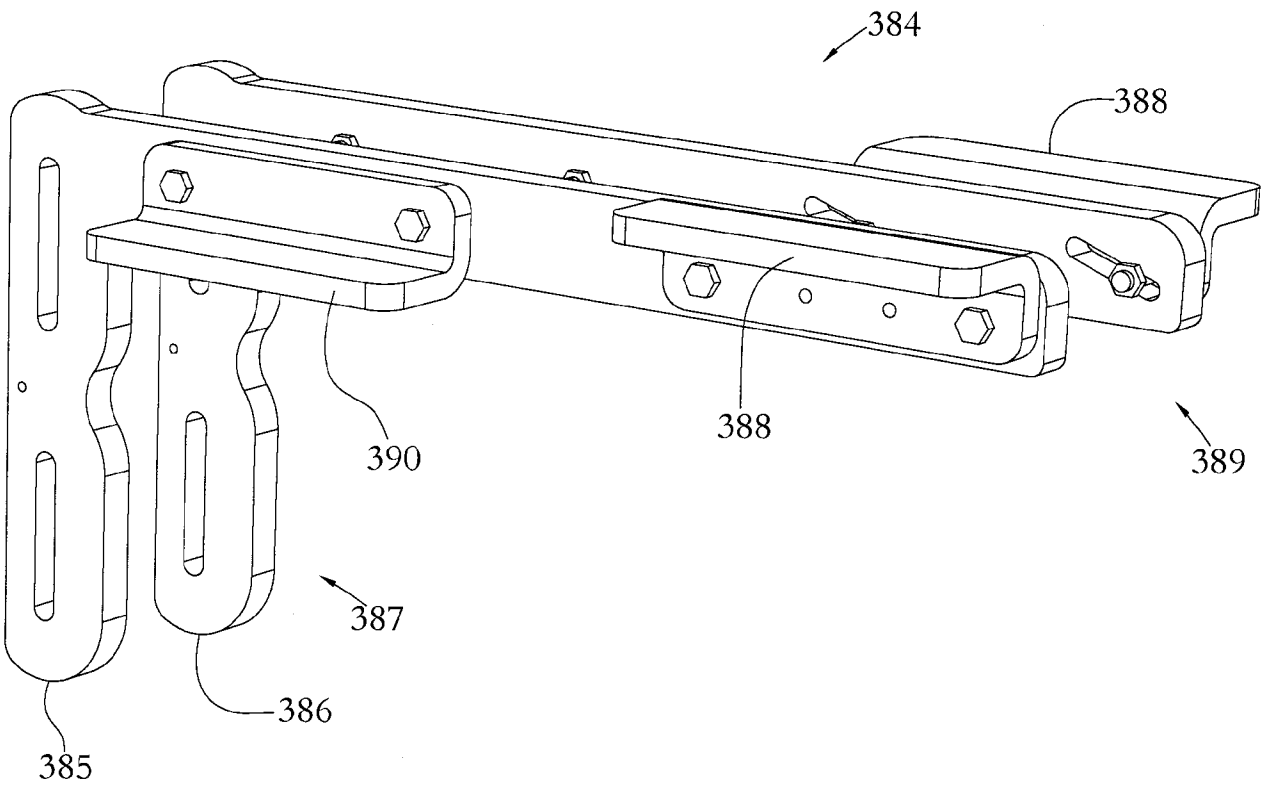
FIG. 16 is a left-side perspective view of a mounting apparatus according to another illustrative embodiment.
Figure 17:
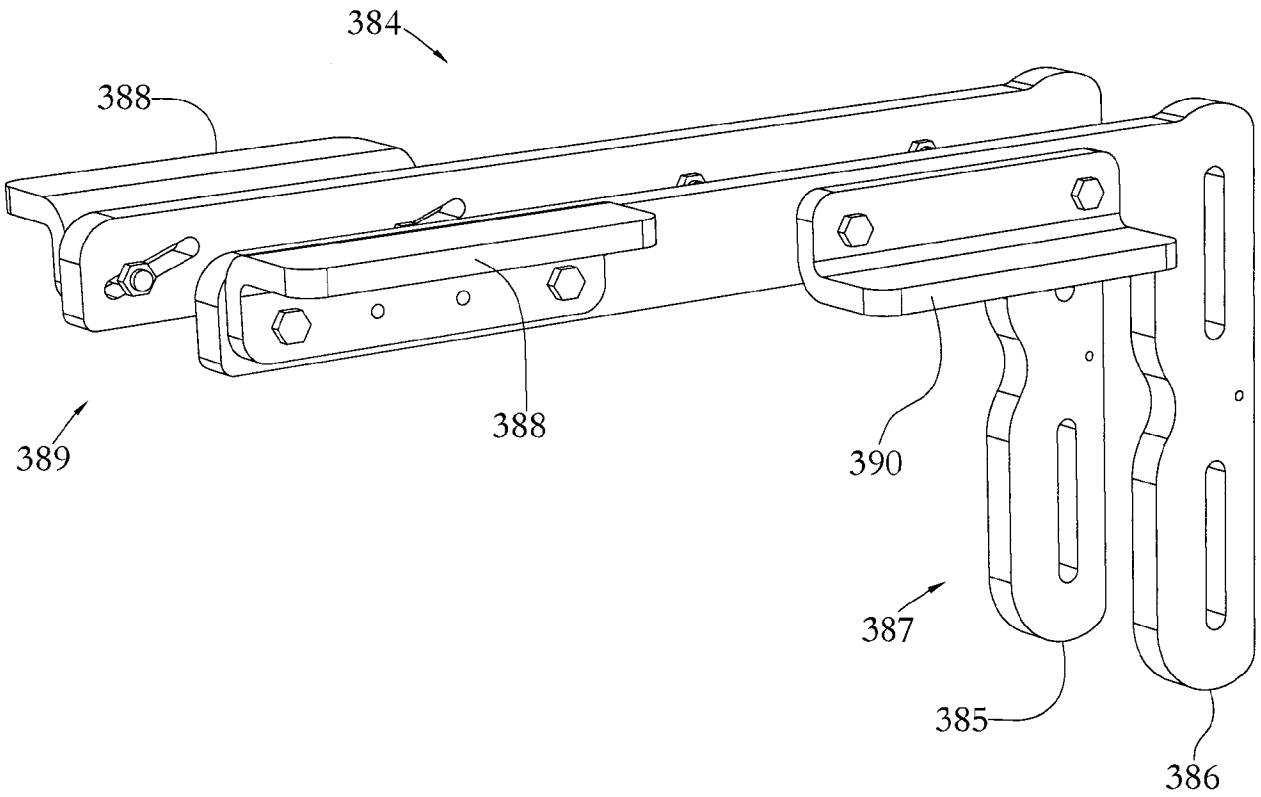
FIG. 17 is a right-side perspective view of the mounting apparatus of FIG. 16.

Referring to FIGS. 16 and 17, a mounting apparatus according to another illustrative embodiment is shown generally at 384 and includes mounting bodies 385 and 386, which are substantially the same as the mounting bodies 334 and 336 shown in FIGS. 13, 14, and 15. The mounting bodies 385 and 386 define a connector shown generally at 387 that functions substantially similarly to the connector 235 shown in Figures shown in FIGS. 6 and 7 and to the connector 342 shown in FIGS. 13 and 14. The mounting apparatus also includes upper holding bodies 388, which are substantially the same has the upper holding bodies 370 and 382, and lower holding bodies 390, which are substantially the same has the lower holding bodies 364 and 380, and the mounting bodies 385 and 386 and the holding bodies 388 and 390 define a holder shown generally at 389 that functions substantially similarly to the holder 236 shown in FIGS. 6 and 7 and to the holder 383 shown in FIGS. 13 and 14. However, in the mounting apparatus 384, the upper holding bodies 388 are positioned such that the upper contact surfaces of the upper holding bodies 388 are on an opposite side of the holder 389 from the connector 387 and the lower contact surfaces of the lower holding bodies 390 on a same side of the holder 389 as the connector 387, whereas in the mounting apparatus 332 shown in FIGS. 13 and 14, the holding bodies 364, 370, 380, and 382 are positioned such that the upper contact surfaces (such as the upper contact surface 376) of the upper holding bodies 370 and 382 are on a same side of the holder 383 as the connector 342 and the lower contact surfaces (such as the lower contact surface 368) of the lower holding bodies 364 and 380 are on an opposite side of the holder 383 from the connector 342.

Thus, in the mounting apparatus 332 shown in FIGS. 13 and 14, the connector 342 may be oriented upwards on a connecting region of a support body as described herein, whereas in the mounting apparatus 384 shown in FIG. 16, the connector 387 may be oriented downwards on a connecting region of a support body as described herein, but on both the mounting apparatuses 332 and 384, the upper contact surfaces are at distal ends of the holders 383 and 389 whereas the lower contact surfaces are at proximal ends of the holders, which in such embodiments may facilitate resisting torque from a load on a stair body hold by such holders because torque from such a load will tend to result in downwards forces at distal ends of the holders and upward forces at proximal ends of the holders.

In general, the mounting apparatuses 160, 332, and 384 described above may be substituted for one another in various embodiments such as the embodiments described herein. For example, although the stair system 130 of the wall assembly 100 includes the mounting apparatus 160, the stair system 130 could include the mounting apparatus 332 instead of the mounting apparatus 160.

Figure 18:
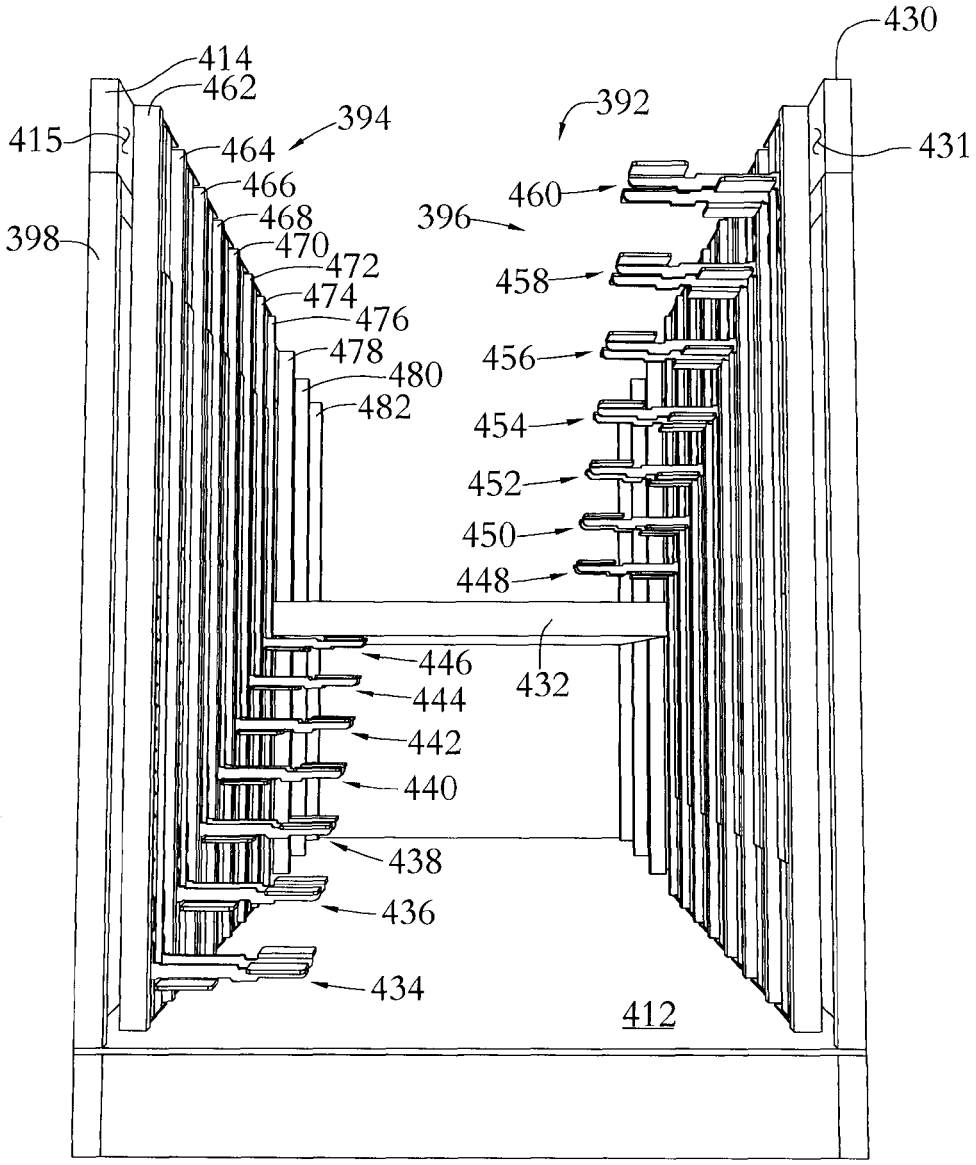
FIG. 18 is an end perspective view of a wall assembly according to another illustrative embodiment.
Figure 19:
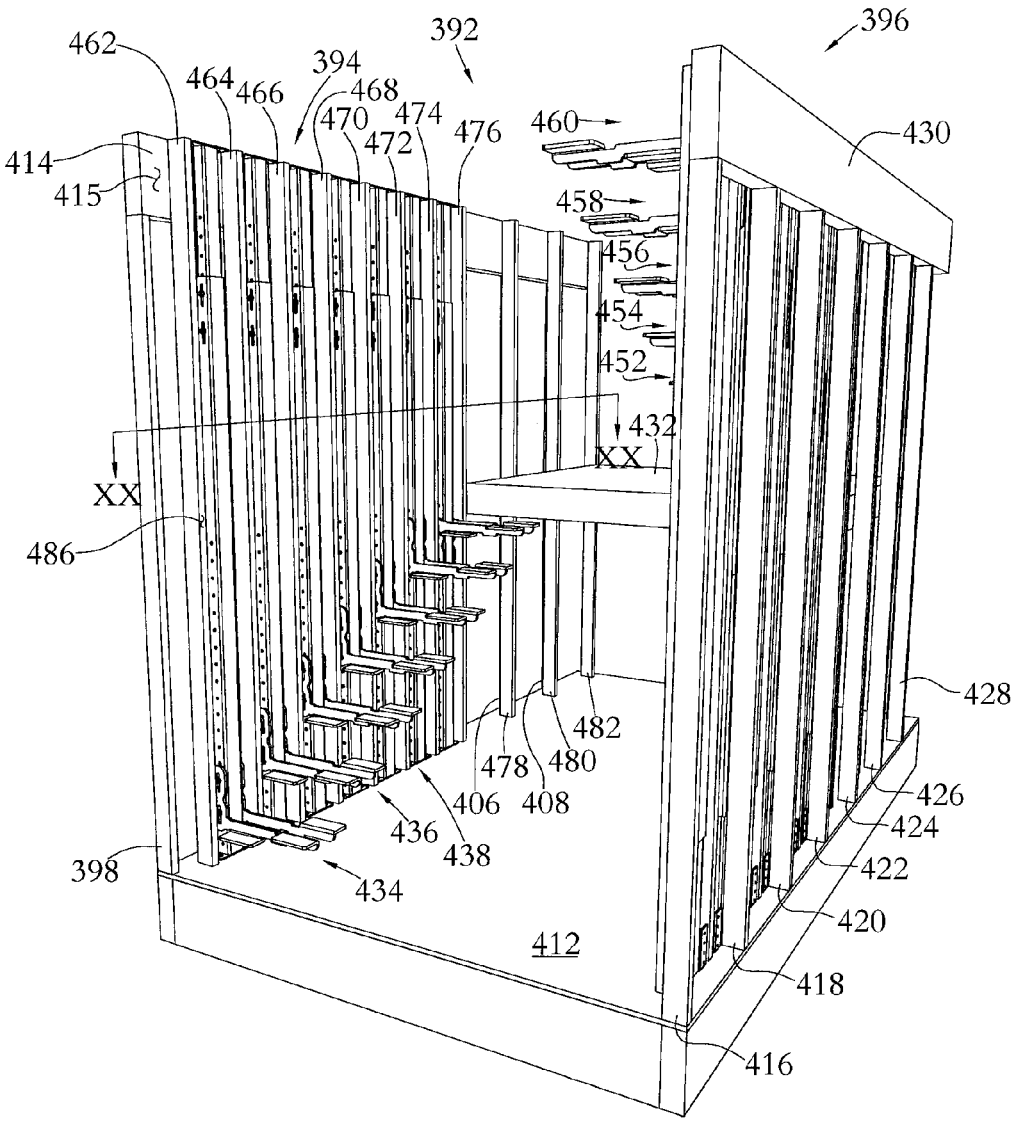
FIG. 19 is a right-side perspective view of the wall assembly of FIG. 18.
Figure 20:
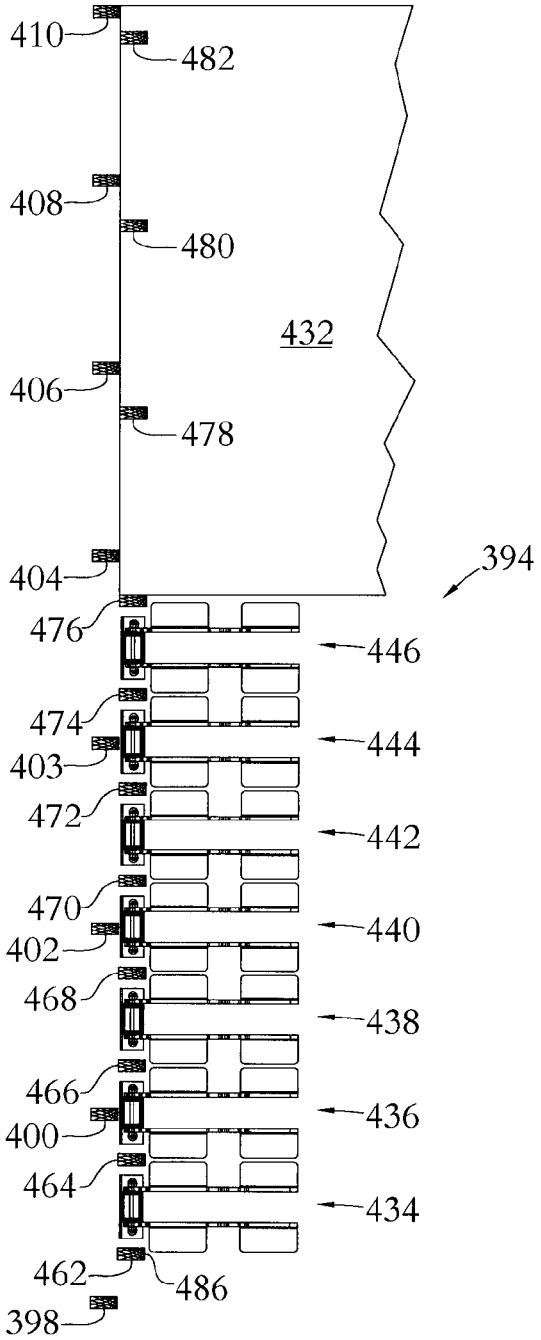
FIG. 20 is a cross-sectional view of a wall of the wall assembly of FIG. 18, taken along the line XX-XX shown in FIG. 19.

Referring to FIGS. 18, 19, and 20, a wall assembly according to another illustrative embodiment is shown generally a 392. The wall assembly 392 includes a first wall shown generally at 394, and a second wall shown generally at 396 and generally parallel to and spaced apart opposite from the first wall 394.

The first wall 394 includes wall studs 398, 400, 402, 403, 404, 406, 408, and 410 extending generally vertically between a floor 412 and a floor joist 414 with generally vertical center lines spaced apart from each other by about 24 inches (or about 61 centimeters). The second wall 396 includes wall studs 416, 418, 420, 422, 424, 426, and 428, which in the embodiment shown extend generally vertically between the floor 412 and a floor joist 430 generally opposite the wall studs 398, 400, 402, 403, 404, 406, 408, and 410 respectively. The floor joists 414 and 430 in the embodiment shown may join the first and second walls 394 and 396 on one level of a building to walls (not shown) above the first and second walls 394 and 396 in a higher level (not shown) of the building.

More particularly, in the embodiment shown, a landing platform 432 is supported by the wall studs 404, 406, 408, 410, 422, 424, 426, and 428 approximately half way up a height of the first and second walls 394 and 396, although in alternative embodiments, a landing platform such as the landing platform 432 may be supported by stair assemblies such as the stair assemblies shown in FIGS. 18 and 19. Further, the first wall 394 includes stair assemblies 434, 436, 438, 440, 442, 444, and 446, and the wall second 396 includes stair assemblies 448, 450, 452, 454, 456, 458, and 460, and such stair assemblies include holding bodies and mounting apparatuses substantially as described above.

Further, referring to FIG. 20, the first wall 394 also includes wall studs 462, 464, 466, 468, 470, 472, 474, and 476 on opposite lateral sides of the support bodies of the stair assemblies 434, 436, 438, 440, 442, 444, and 446, and wall studs 478, 480, and 482 generally parallel to and spaced apart from the wall studs 462, 464, 466, 468, 470, 472, 474, and 476. The wall studs 462, 464, 466, 468, 470, 472, 474, 476, 478, 480, and 482 thus form a wall stud layer generally parallel to and spaced apart from a wall stud layer formed from the wall studs 398, 400, 402, 403, 404, 406, 408, and 410. In other words, outer surfaces of the wall studs 398, 400, 402, 403, 404, 406, 408, and 410 and inner surfaces of the wall studs 462, 464, 466, 468, 470, 472, 474, 476, 478, 480, and 482 are generally coplanar, and together the wall studs 398, 400, 402, 403, 404, 406, 408, 410, 462, 464, 466, 468, 470, 472, 474, 476, 478, 480, and 482 form the first wall 394.

In the embodiment shown, the wall studs 398, 400, 402, 403, 404, 406, 408, and 410 may be pre-existing wall studs in the first wall 394 in that such wall studs may have existed in a home or other building before the stair assemblies 434, 436, 438, 440, 442, 444, and 446 and the wall studs 462, 464, 466, 468, 470, 472, 474, 476, 478, 480, and 482 are added to such a pre-existing wall to form the first wall 394. As such, stair bodies on the stair assemblies 434, 436, 438, 440, 442, 444, and 446 may form a staircase added to the pre-existing wall by adding the stair assemblies 434, 436, 438, 440, 442, 444, and 446 and the wall studs 462, 464, 466, 468, 470, 472, 474, 476, 478, 480, and 482 to the pre-existing wall. Alternatively, the entire first wall 394, including the wall studs 398, 400, 402, 403, 404, 406, 408, 410, 462, 464, 466, 468, 470, 472, 474, 476, 478, 480, and 482 and the stair assemblies 434, 436, 438, 440, 442, 444, and 446, may be constructed together as part of construction of a new home or other building, for example. Either way, in the embodiment shown, the support bodies of the stair assemblies 434, 436, 438, 440, 442, 444, and 446 are between respective pairs of the wall studs 462, 464, 466, 468, 470, 472, 474, and 476, thereby leaving spaces between the wall studs 398, 400, 402, 403, 404, 406, 408, and 410 free for electrical conduits and plumbing pipes (not shown), for example, to pass through without interference from stair assemblies such as the stair assemblies 434, 436, 438, 440, 442, 444, and 446. Further, as shown in FIGS. 18 and 19 for example, the support bodies of the stair assemblies 434, 436, 438, 440, 442, 444, and 446 extend over an outer surface 415 of the floor joist 414, and the support bodies of the stair assemblies 448, 450, 452, 454, 456, 458, and 460 extend over an outer surface 431 of the floor joist 430, and thus, in the embodiment shown, stair bodies may be held at a level or proximate a level of one of the floor joists 414 and 430 (such as a stair body not shown on the stair assembly 460 for example) without requiring mounting bodies such as the mounting apparatus 490 shown in FIGS. 1 and 12 to extend over such floor joists.

Figure 21:
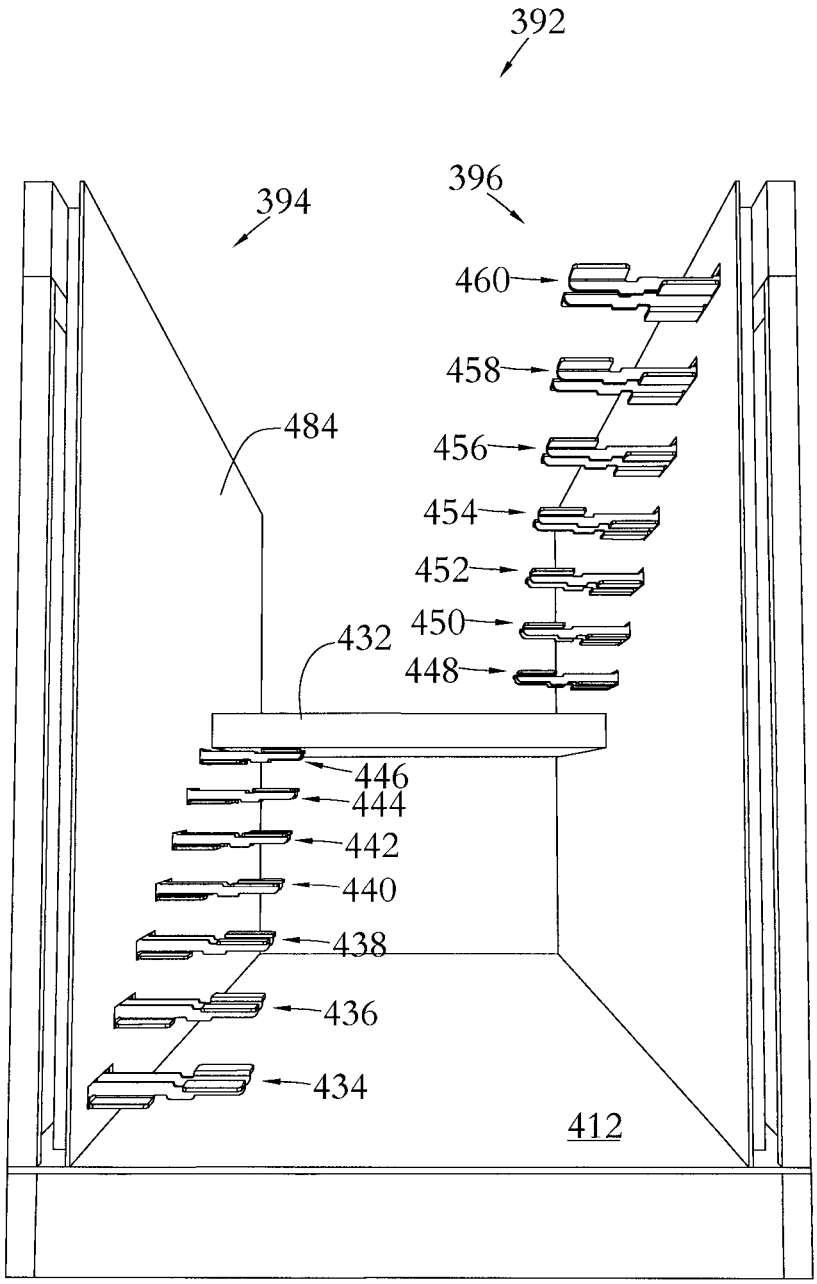
FIG. 21 is an end perspective view of the wall assembly of FIG. 18, showing wall panels included in walls of the wall assembly of FIG. 18.
Figure 22:
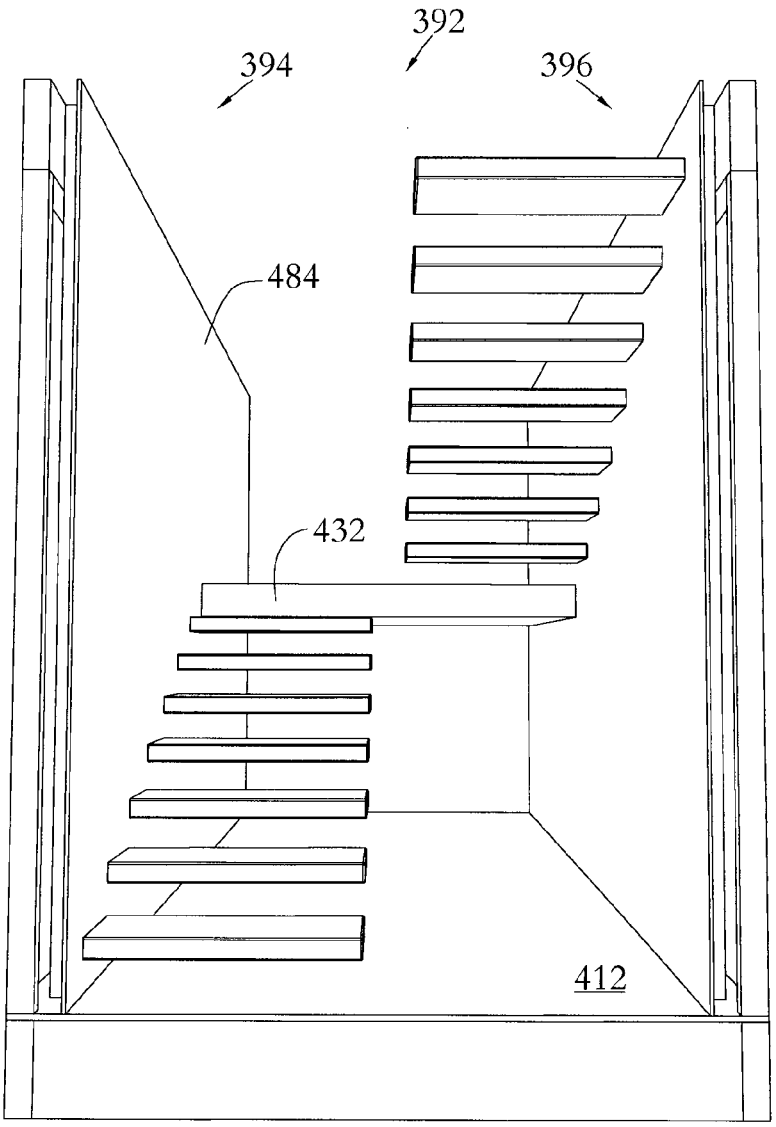
FIG. 22 is an end perspective view of the wall assembly of FIG. 18, showing wall panels included in walls of the wall assembly of FIG. 18 and showing stair bodies on stair assemblies of the wall assembly of FIG. 18.

Referring to FIGS. 20 and 21, the first wall 394 is shown with a wall panel 484, which may include one or more drywall panels for example, mounted on front surfaces (such as the front surface 310) of the wall studs 462, 464, 466, 468, 470, 472, 474, 476, 478, 480, and 482. Through-openings (not shown) are cut through the wall panel 484 to permit the holders of the stair assemblies 434, 436, 438, 440, 442, 444, and 446 to pass through the wall panel 484 to be received in the cavities of stair bodies substantially as described above and shown in FIG. 22. In the embodiment shown, such through-openings in the wall panel 484 are large enough to permit the holders to pass therethrough, but small enough to be concealed by the stair bodies when the holders are received in the cavities of the stair bodies as shown in FIG. 22.

The second wall 396 is substantially the same as the first wall 394, except that as shown in FIG. 21, the second wall 396 is inverted with respect to the first wall 394 so that the holders of the stair assemblies 434, 436, 438, 440, 442, 444, and 446 extend from the first wall 394 towards the second wall 396, and the holders of the stair assemblies 448, 450, 452, 454, 456, 458, and 460 extend from the second wall 396 towards the first wall 394. Further, the holders of the stair assemblies 434, 436, 438, 440, 442, 444, and 446 ascend sequentially from the floor 412 to the landing platform 432, and the holders of the stair assemblies 448, 450, 452, 454, 456, 458, and 460 ascend sequentially from the landing platform 432 such that when stair bodies are held by the holders of the stair assemblies 434, 436, 438, 440, 442, 444, 446, 448, 450, 452, 454, 456, 458, and 460 as shown in FIG. 22, such stair bodies collectively form a staircase with the landing platform 432 ascending from the floor 412 to a level above the floor 412 (not shown). In alternative embodiments, staircases may not include landing platforms, and may instead include stairs in a straight run, such as in the embodiment shown in FIG. 1 for example.

Figure 23:
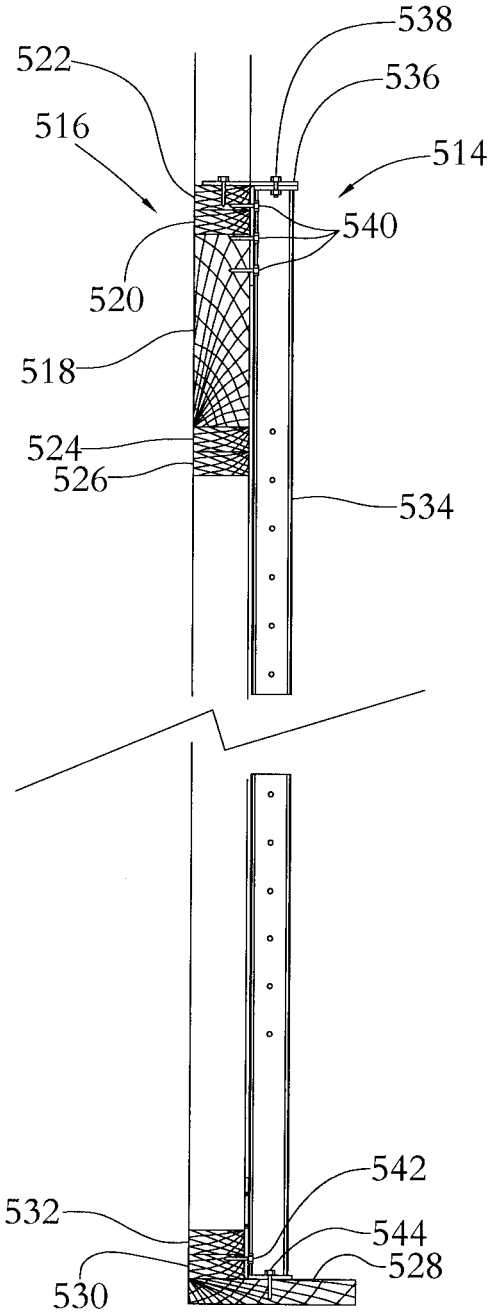
FIG. 23 is a broken elevation view of a wall assembly according to another illustrative embodiment.

Referring to FIG. 23, a wall assembly according to another illustrative embodiment is shown generally at 514. The wall assembly 514 includes a wall shown generally at 516, which includes a generally horizontal beam 518, generally horizontal wall studs 520 and 522 above the beam 518, generally horizontal wall studs 524 and 526 below the beam 518, a generally horizontal floor 528 below the beam 518, and generally horizontal wall studs 530 and 532 above the floor 528. The wall assembly 514 also includes a support body 534, which is substantially the same as the support body 158, and which is mounted in the wall 516 as shown in FIG. 23. More particularly, a generally planar bracket 536 is fastened both to the wall stud 522 on an upper surface of the wall stud 522, and to a fastening body on an upper end of the support body 534 by passing fasteners 538 through the bracket 536 and through generally vertical through-openings of the fastening body on the upper end of the support body 534. Further, the support body 534 is mounted in the wall 516 by passing fasteners 540 through generally horizontal through-openings of the fastening body on the upper end of the support body 534 and into one or more of the beam 518 and the wall studs 520, 522, 524, and 526, by passing fasteners 542 through generally horizontal through-openings of a fastening body on a lower end of the support body 534 and into one or more of the wall studs 530 and 532, and by passing fasteners 544 through generally vertical through-openings of the fastening body on the lower end of the support body 534 and into the floor 528.

Figure 24:
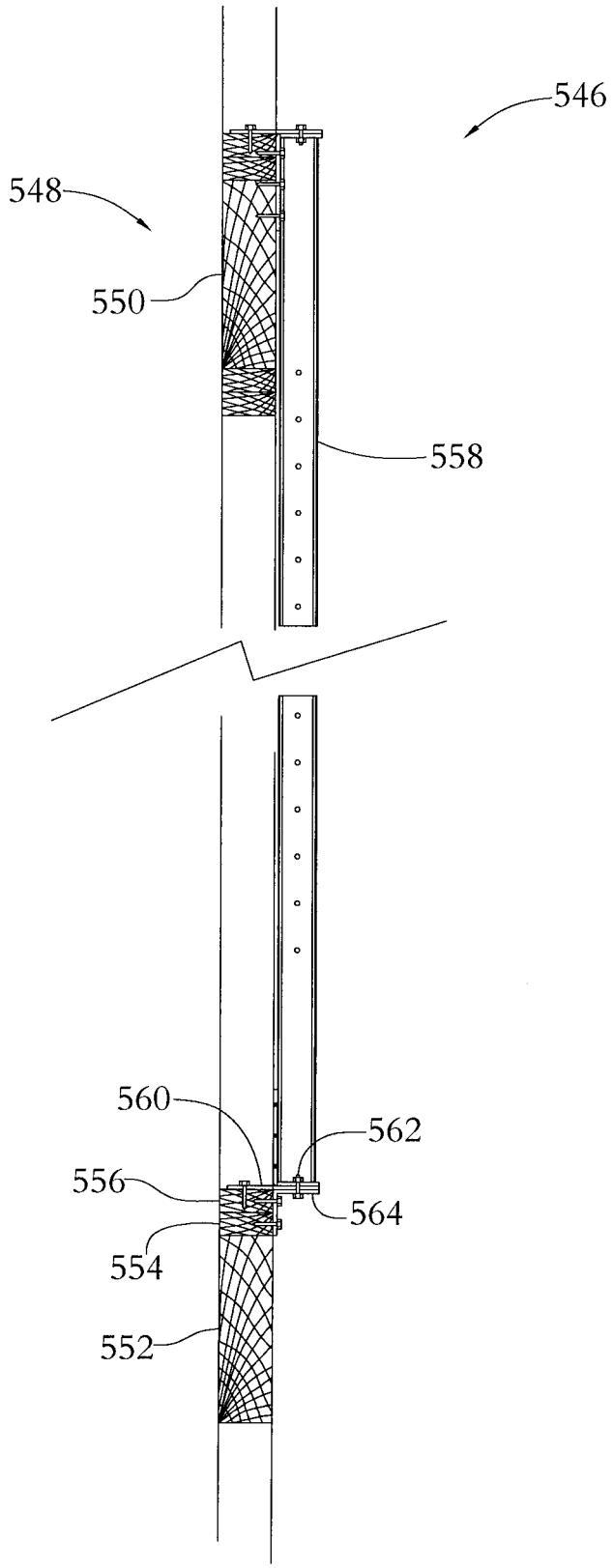
FIG. 24 is a broken elevation view of a wall assembly according to another illustrative embodiment.

Referring to FIG. 24, a wall assembly according to another illustrative embodiment is shown generally at 546. The wall assembly 546 includes a wall shown generally at 548, which includes generally horizontal, generally parallel, and vertically spaced apart beams 550 and 552, and which also includes generally horizontal wall studs 554 and 556 above the lower beam 552. The wall assembly 546 also includes a support body 558, which is substantially the same as the support body 158, and which is mounted in the wall 548 as shown in FIG. 24. More particularly, a fastening body on an upper end of the support body 558 is fastened similarly to the fastening body on the upper end of the support body 534 as shown in FIG. 23 and as described above. Further, the support body 558 is mounted in the wall 548 by fastening a generally planar bracket 560 both to the wall stud 556 on an upper surface of the wall stud 556, and to a fastening body on a lower end of the support body 558 by passing fasteners 562 through the bracket 560 and through generally vertical through-openings of the fastening body on the lower end of the support body 558. Still further, the support body 558 is mounted in the wall 548 by fastening a generally L-shaped bracket 564 to the wall studs 554 and 556, and to the fastening body on the lower end of the support body 558 by passing the fasteners 562 through the bracket 564.

Figure 25:
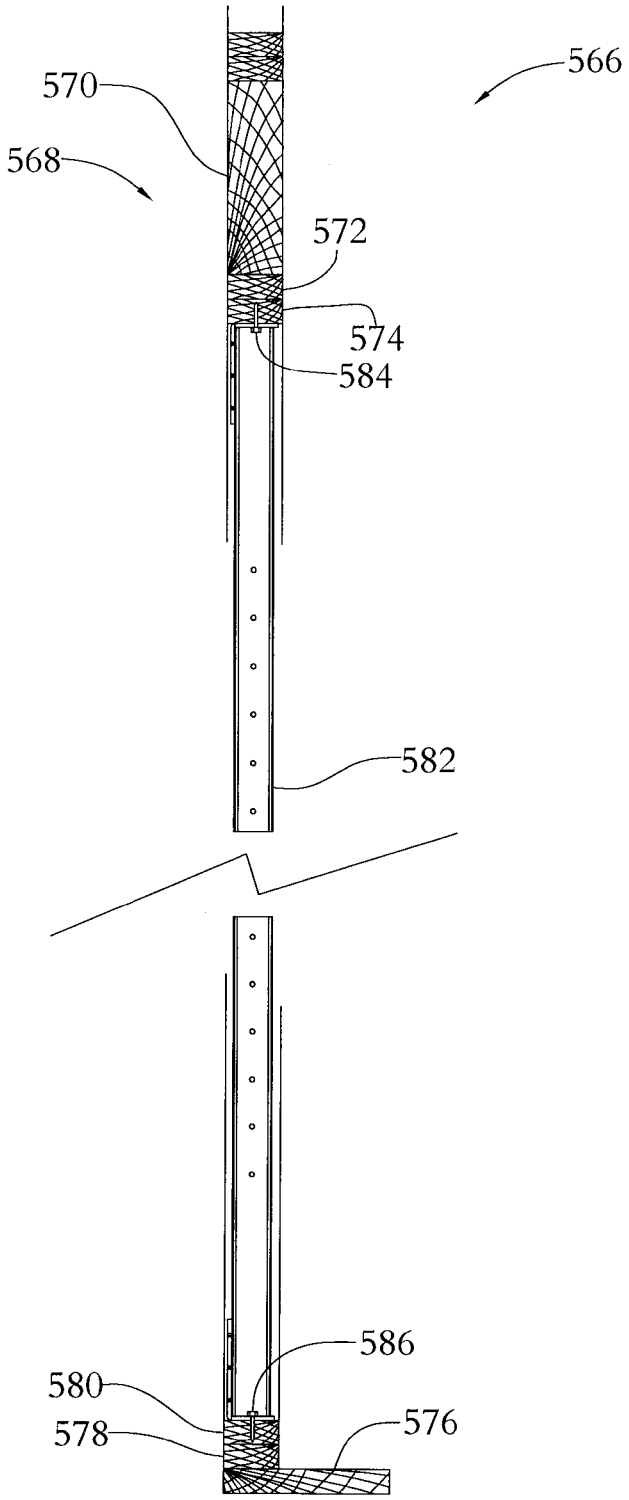
FIG. 25 is a broken elevation view of a wall assembly according to another illustrative embodiment.

Referring to FIG. 25, a wall assembly according to another illustrative embodiment is shown generally at 566. The wall assembly 566 includes a wall shown generally at 568, which includes a generally horizontal beam 570, generally horizontal wall studs 572 and 574 below the beam 570, a generally horizontal bottom plate 576 below the beam 570, and generally horizontal wall studs 578 and 580 above the bottom plate 576. The wall assembly 566 also includes a support body 582, which is substantially the same as the support body 158, and which is mounted in the wall 568 as shown in FIG. 25. More particularly, the support body 582 is mounted in the wall 568 by passing fasteners 584 through generally vertical through-openings of a fastening body on an upper end of the support body 582 and into the wall stud 574, and by passing fasteners 586 through generally vertical through-openings of a fastening body on a lower end of the support body 582 and into the wall stud 580.

The wall assemblies described above are illustrative of numerous ways that a support body may be mounted in a wall, and in alternative embodiments, various support bodies such as those described herein may be mounted in various walls in numerous other ways. Further, although the beams, wall studs, top plates, and bottom plates shown in FIGS. 1 and 18 to 25 are illustrated as wood, alternative embodiments may include numerous other materials such as metal studs and concrete floors and walls for example.

In general, embodiments such as those described above may form staircases of stair bodies each single-cantilevered on a single end of the stair body while concealing the structure supporting the stair body from view either within a wall or within the stair body itself, and such staircases may be more desirable in appearance than other staircases that support stair bodies in other ways, and further such staircases may occupy less space than other staircases that support stair bodies in other ways. Further, the support bodies and mounting apparatuses described above may, in some embodiments, permit such stairs to be cantilevered independently of each other, of studs in a wall, and of wall panels of a wall, which may prevent damage to the wall panels that could result from the transfer of loads from the stair bodies to the wall panels. Still further, in embodiments such as those described above, the support bodies are adjustable in length to fit particular walls, the mounting apparatuses are connectable to the support bodies at a significant variety of heights along connecting regions of the support bodies, and the stair bodies can be fastened at desired positions on the holders of the mounting apparatuses, for example to ensure a desired spacing distance between an open end of the stair bodies and the support bodies.

Although specific embodiments have been described and illustrated, such embodiments should be considered illustrative only and not as limiting the invention as construed in accordance with the accompanying claims.

What is claimed is:

1. A stair system comprising:

a support body mountable in a wall and comprising a connecting region, wherein the support body comprises first and second spaced apart fastening bodies configured to fasten the support body to respective spaced apart regions of the wall;

a stair body; and a mounting apparatus comprising:

a connector connectable to the connecting region of the support body in any one of a plurality of different positions in the connecting region of the support body; and a holder configured to hold the stair body such that when the connector is connected to the connecting region of the support body, the holder is configured to hold the stair body in a position that is spaced apart from the support body and that permits a generally planar wall panel to be positioned between the stair body and the support body and perpendicular to the stair body when the mounting apparatus extends through the wall panel.

2. The stair system of claim 1 wherein the first fastening body comprises at least one through-opening to receive a respective at least one fastener, and wherein the second fastening body comprises at least one through-opening to receive a respective at least one fastener.

3. The stair system of claim 1 wherein the first and second fastening bodies are proximate respective opposite ends of the support body.

4. The stair system of claim 1 wherein the connecting region of the support body is between the first and second fastening bodies of the support body.

5. The stair system of claim 1 wherein the support body is adjustable in length to vary a distance between the first and second fastening bodies of the support body.

6. The stair system of claim 5 wherein the support body comprises:

a first portion comprising the first fastening body; and a second portion comprising the second fastening body and telescopically receivable in the first portion.

7. The stair system of claim 1 wherein the connector of the mounting apparatus is connectable to the support body at any one of a plurality of spaced apart connection locations on the connecting region of the support body.

8. The stair system of claim 7 wherein the connecting region of the support body defines a respective at least one through-opening at each one of the plurality of connection locations, and wherein the connector of the mounting apparatus comprises at least one through-opening configured to be positioned adjacent the respective at least one through-opening of any one of the plurality of connection locations, whereby at least one fastener is receivable through the at least one through-opening of the connector of the mounting apparatus and through the respective at least one through-opening of a selected one of the plurality of connection locations to connect the connector of the mounting apparatus to the connecting region of the support body at the selected one of the plurality of connection locations.

9. The stair system of claim 8 wherein the at least one through-opening of the connector of the mounting apparatus is elongate to permit the mounting apparatus to be connected to the connecting region of the support body over a respective range of positions around each one of the plurality of connection locations.

10. The stair system of claim 9 wherein the at least one through-opening of the connector of the mounting apparatus is at least as long as a spacing distance between adjacent ones of the plurality of connection locations to permit the mounting apparatus to be connected to the connecting region of the support body in any one of a plurality of different positions continuously available along the connecting region.

11. The stair system of claim 1 wherein the connecting region extends about half of a height of the support body.

12. The stair system of claim 1 wherein the support body has a width of about 7.6 centimeters.

13. The stair system of claim 1 wherein the stair body defines a cavity open at an open end of the stair body, and wherein the holder of the mounting apparatus is sized to be received in the cavity of the stair body.

14. The stair system of claim 13 wherein the stair body defines at least one through-opening, and wherein the holder of the mounting apparatus defines at least one through-opening positioned to be aligned with the at least one through-opening of the stair body when the holder of the mounting apparatus is received in the cavity of the stair body, whereby at least one fastener is receivable in the at least one through-opening of the stair body and in the at least one through-opening of the holder of the mounting apparatus to fasten the stair body to the holder of the mounting apparatus.

15. The stair system of claim 13 wherein the mounting apparatus is configured to be concealed substantially by the wall panel and by the stair body when the connector of the mounting apparatus is positioned on an inside of the wall panel and when the holder of the mounting apparatus is received in the cavity of the stair body on an outside of the wall panel opposite the inside of the wall panel.

16. The stair system of claim 13 wherein the holder of the mounting apparatus comprises at least one upper contact surface for contacting an upper surface of the cavity of the stair body when the holder of the mounting apparatus is received in the cavity of the stair body, and at least one lower contact surface for contacting a lower surface of the cavity of the stair body when the holder of the mounting apparatus is received in the cavity of the stair body.

17. The stair system of claim 16 wherein the holder of the mounting apparatus comprises at least one upper flange having the at least one upper contact surface, and at least one lower flange having the at least one lower contact surface.

18. The stair system of claim 17 wherein the at least one upper flange is adjustable to permit adjustment of a distance between a plane including the at least one upper contact surface and a plane including the at least one lower contact surface.

19. The stair system of claim 17 wherein the at least one lower flange is adjustable to permit adjustment of a distance between a plane including the at least one upper contact surface and a plane including the at least one lower contact surface.

20. The stair system of claim 16 wherein the at least one upper contact surface of the mounting apparatus and the at least one lower contact surface of the mounting apparatus extend transversely and longitudinally relative to the holder of the mounting apparatus to prevent movement of the stair body about the holder of the mounting apparatus when the holder of the mounting apparatus is received in the cavity of the stair body.

21. The stair system of claim 1 wherein the holder of the mounting apparatus extends generally perpendicular to the connector of the mounting apparatus.

22. A wall assembly comprising:

a wall comprising a plurality of wall studs and a wall panel mounted on front surfaces of the wall studs; and a first stair system according to claim 1;

wherein the support body of the first stair system is mounted in the wall;

wherein the connector of the mounting apparatus of the first stair system is connected to the connecting region of the support body of the first stair system in one of the plurality of different positions in the connecting region of the support body of the first stair system; and wherein the holder of the mounting apparatus of the first stair system holds the stair body of the first stair system such that the stair body of the first stair system is spaced apart from the support body of the first stair system with the wall panel between the stair body of the first stair system and the support body of the first stair system.

23. The wall assembly of claim 22 wherein the support body of the first stair system is mounted in the wall independently of the wall studs.

24. The wall assembly of claim 22 wherein the stair body of the first stair system is supported only by the holder of the mounting apparatus of the first stair system whereby the stair body of the first stair system is single-cantilevered only at one end of the stair body of the first stair system.

25. The wall assembly of claim 22 further comprising a second stair system comprising:

a support body mountable in the wall and comprising a connecting region, wherein the support body comprises first and second spaced apart fastening bodies configured to fasten the support body to respective spaced apart regions of the wall;

a stair body; and a mounting apparatus comprising:

a connector connectable to the connecting region of the support body in any one of a plurality of different positions in the connecting region of the support body; and a holder configured to hold the stair body such that when the connector is connected to the connecting region of the support body, the stair body is spaced apart from the support body to permit the wall panel between the stair body and the support body;

wherein the support body of the second stair system is mounted in the wall;

wherein the connector of the mounting apparatus of the second stair system is connected to the connecting region of the support body of the second stair system in one of the plurality of different positions in the connecting region of the support body of the second stair system; and wherein the holder of the mounting apparatus of the second stair system holds the stair body of the second stair system such that the stair body of the second stair system is spaced apart from the support body of the second stair system with the wall panel between the stair body of the second stair system and the support body of the second stair system.

26. The wall assembly of claim 25 wherein the support body of the second stair system is mounted in the wall independently of the wall studs.

27. The wall assembly of claim 25 wherein the support body of the second stair system is mounted in the wall independently of the support body of the first stair system.

28. The wall assembly of claim 25 wherein the stair body of the second stair system is supported only by the holder of the mounting apparatus of the second stair system whereby the stair body of the second stair system is single-cantilevered only at one end of the stair body of the second stair system.

* * * * *